US009661697B2

(12) United States Patent
Sadwick et al.

(10) Patent No.: US 9,661,697 B2
(45) Date of Patent: May 23, 2017

(54) DIGITAL DIMMABLE DRIVER

(71) Applicants: Laurence P. Sadwick, Salt Lake City, UT (US); William B. Sackett, Salt Lake City, UT (US)

(72) Inventors: Laurence P. Sadwick, Salt Lake City, UT (US); William B. Sackett, Salt Lake City, UT (US)

( * ) Notice: Subject to any disclaimer, the term of this patent is extended or adjusted under 35 U.S.C. 154(b) by 318 days.

(21) Appl. No.: 14/214,515

(22) Filed: Mar. 14, 2014

(65) Prior Publication Data

US 2014/0265935 A1 Sep. 18, 2014

Related U.S. Application Data

(60) Provisional application No. 61/786,047, filed on Mar. 14, 2013.

(51) Int. Cl.
*H05B 33/08* (2006.01)

(52) U.S. Cl.
CPC ..... *H05B 33/0815* (2013.01); *H05B 33/0845* (2013.01); *H05B 33/0851* (2013.01); *H05B 33/0884* (2013.01)

(58) Field of Classification Search
CPC ..... H05B 33/0815; H05B 33/0818; H05B 33/0884; H05B 33/0809; H05B 33/0848; H05B 33/0896
USPC ..... 315/291, 194, 307, 247, 200 R
See application file for complete search history.

(56) References Cited

U.S. PATENT DOCUMENTS 5,872,429 A * 2/1999 Xia ..... H05B 37/0263 315/194
7,804,256 B2 * 9/2010 Melanson ..... H05B 33/0815 315/224
8,120,341 B2 * 2/2012 Melanson ..... H02M 1/4225 323/282
8,482,223 B2 * 7/2013 Draper ..... H05B 37/0218 315/209 R
8,536,799 B1 * 9/2013 Grisamore ..... H05B 33/0848 315/185 R
8,674,605 B2 * 3/2014 Puvanakijjakorn ..... H05B 33/0809 315/200 R
8,933,648 B1 * 1/2015 Putman ..... H05B 33/0815 315/291
9,207,265 B1 * 12/2015 Grisamore ..... G01R 19/0046
9,240,725 B2 * 1/2016 Melanson ..... H02M 1/36
2009/0243582 A1 * 10/2009 Irissou ..... H05B 39/08 323/320
2011/0204803 A1 * 8/2011 Grotkowski ..... H05B 33/0815 315/194
2012/0230073 A1 * 9/2012 Newman, Jr. ..... H05B 33/0815 363/126
2012/0299500 A1 * 11/2012 Sadwick ..... H05B 33/0887 315/224
2013/0193879 A1 * 8/2013 Sadwick ..... H05B 33/0818 315/307
2014/0009082 A1 * 1/2014 King ..... H05B 37/02 315/247

(Continued)

*Primary Examiner* — Douglas W Owens
*Assistant Examiner* — Syed M Kaiser

(57) ABSTRACT

A digital dimmable driver system includes an alternating current input, a dimmer operable to perform a phase cut operation on a waveform from the alternating current input, a driver circuit operable to switch from a dimming mode to a universal voltage input mode based on a phase angle of the dimmer, and a power output operable to power a light.

19 Claims, 10 Drawing Sheets

(56) References Cited

U.S. PATENT DOCUMENTS

| | | | | |
|---|---|---|---|---|
| 2014/0055052 | A1* | 2/2014 | Zudrell-Koch ..... | H05B 37/02<br>315/200 R |
| 2014/0265899 | A1* | 9/2014 | Sadwick ..... | H05B 33/0812<br>315/200 R |

* cited by examiner

DIGITAL DIMMABLE DRIVER

BACKGROUND

Electricity is generated and distributed in alternating current (AC) form, wherein the voltage varies sinusoidally between a positive and a negative value. However, many electrical devices require a direct current (DC) supply of electricity having a constant voltage level, or at least a supply that remains positive even if the level is allowed to vary to some extent. For example, light emitting diodes (LEDs) and similar devices such as organic light emitting diodes (OLEDs) are being increasingly considered for use as light sources in residential, commercial and municipal applications. However, in general, unlike incandescent light sources, LEDs and OLEDs cannot be powered directly from an AC power supply unless, for example, the LEDs are configured in some back to back formation. Electrical current flows through an individual LED easily in only one direction, and if a negative voltage which exceeds the reverse breakdown voltage of the LED is applied, the LED can be damaged or destroyed. Furthermore, the standard, nominal residential voltage level is typically something like 120 V or 240 V, both of which are higher than may be desired for a high efficiency LED light. Some conversion of the available power may therefore be necessary or highly desired with loads such as an LED light.

In one type of commonly used power supply for loads such as an LED, an incoming AC voltage is connected to the load only during certain portions of the sinusoidal waveform. For example, a fraction of each half cycle of the waveform may be used by connecting the incoming AC voltage to the load each time the incoming voltage rises to a predetermined level or reaches a predetermined phase and by disconnecting the incoming AC voltage from the load each time the incoming voltage again falls to zero. In this manner, a positive but reduced voltage may be provided to the load. This type of conversion scheme is often controlled so that a constant current is provided to the load even if the incoming AC voltage varies. However, if this type of power supply with current control is used in an LED light fixture or lamp, a conventional dimmer is often ineffective. For many LED power supplies, the power supply will attempt to maintain the constant current through the LED despite a drop in the incoming voltage by increasing the on-time during each cycle of the incoming AC wave.

Dimmer circuits are generally used to regulate the illumination level output from a light by controlling the current, voltage or power available to the light through any of a number of mechanisms or regulation schemes. Dimmer circuits may also be used with other types of loads to control the work performed by the load. Dimmer circuits are typically designed to operate with a specific input voltage. If they are used with a different input voltage, current may rise above safe levels and damage loads such as LEDs. The behavior of the dimmer circuit may also be altered, with the dimming range being compressed or expanded. In addition, dimming using conventional AC dimmers including Triac-based dimmers can often be problematic including for dimming of LEDs, fluorescent lamps (FLs) including cold cathode fluorescent lamps (CCFLs), compact fluorescent lamps (CFLs), energy efficient lighting, etc.

SUMMARY

A digital dimmable power supply that can be used as a dimmable power supply, driver, ballast, etc. with a Triac, other forward and reverse dimmers, and universal dimmers is disclosed which variably controls an output up to a certain level, above which the output is regulated at a constant level. For example, in a current controlling dimmer, provided an input voltage of up to 120VAC, the average output current may be adjusted up or down to make a lamp brighter or dimmer, and provided an input voltage above 120VAC, such as 220VAC, the output current is regulated at a fixed level, such as a level that sets the lamp at a normal fully on illumination level or the digital driver/power supply/ballast may be designed and implemented to dim at or around both 120 VAC and at or around 200 to 240 VAC and also at or around 277 VAC and so on including 347 VAC and higher (i.e., 480 VAC). Such features of the present invention can be selected for example manually or automatically or programmed. The digital dimmable driver/power supply/ballast with either a standard, fixed voltage dimmer or a universal dimmer of any type may be adapted to any type of regulation scheme, such as current control, voltage control, DC output, AC output with various types of waveforms and modulations, etc. For example, an AC output may be dimmed using phase control, amplitude modulation and truncation, or any other means. The level at which the digital universal dimmer switches from a dimming mode to a constant output mode can be at a fixed predetermined level or may be dynamically determined by any suitable determination system, such as the state of a manually or automatically operated switch, monitoring the electrical characteristics of the input and/or output, changing the input phase angle dimming range based on the characteristics and performance of the dimmer including a triac dimmer, using temperature or light sensors, interfacing with smart phones, remote controls, tablets, laptops, digital assistants, computers, servers, etc. and adjusting parameters in the universal dimmer accordingly, etc.

In one embodiment of a universal dimmer, a power and/or current limiting switch is connected to an input voltage. The universal digital dimmable driver includes a power input and a load path, with the power input being connected to the input voltage. A variable pulse generator includes a control input and a pulse output, with the control input connected to a control input of the power limiting switch. The pulse output is connected to a control input of the power limiting switch. The variable pulse generator is adapted to vary a duty cycle at the pulse output. The universal dimmer also includes a load current detector having an input and an output. The load current detector input is connected to the output driver load path. The load current detector and feedback and control output is connected to the variable pulse generator control input. The variable pulse generator and the load current detector are adapted to limit the duty cycle when a load current reaches a maximum current limit to substantially prevent the load current from exceeding the maximum current limit and also to respond to, for example but not limited to, phase angle/phase information from, for example, but not limited to, Triacs and other forward and reverse phase angle dimmers. In addition, the present invention can also be used to provide a constant output voltage that can be dimmed in a similar manner to the output current discussed above.

BRIEF DESCRIPTION OF THE DRAWINGS

A further understanding of the various embodiments may be realized by reference to the figures which are described in remaining portions of the specification. In the figures, like reference numerals may be used throughout several drawings to refer to similar components.

DESCRIPTION

Figure 1:
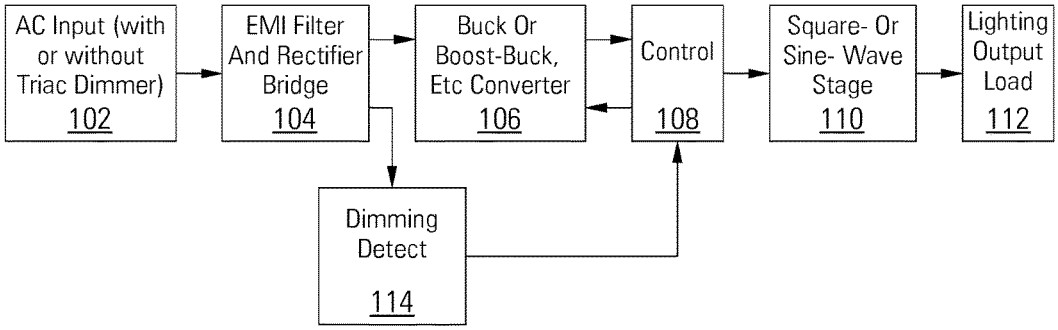
FIG. 1 depicts a block diagram of a universal digital dimmer power supply/driver including a square or sine wave stage in accordance with some embodiments.

Dimming drivers are typically designed for use over a relatively narrow input voltage range and are typically not protected from damage at other voltages outside the relatively narrow voltage range. The present invention addresses this and other limitations and provides circuits for driving various loads including, but not limited to, light emitting diodes (LEDs) of all types with some examples being high brightness LEDs, arrays of LEDs and organic LEDs (OLEDs); it is also possible to apply the present invention to dimming fluorescent, incandescent, gas discharge, neon, and/or any combination of lighting, etc. In addition, universal dimmers to drive the digital dimming driver, ballast and power supply circuits are also disclosed. The digital dimmable driver circuits can also be designed to be able to switch from dimming mode to universal voltage input operation based on the phase angle of a dimmer such as a Triac or other forward or reverse dimmer including the universal dimmers disclosed herein. The present invention can be designed to be used with dimmers in the voltage range of less than 100 VAC to greater than 277 VAC and up to 480 VAC and higher. In some embodiments such a dimming to universal constant current driver/power supply can be realized and implemented with both high power factor during dimming and also high power factor when in the saturated set point constant output current universal input voltage mode.

Such a switch/change in modes can be accomplished by a number of methods including manual mode via, for example, a switch that can be manually moved to change the value of a circuit component or parameter such as a resistor or voltage, respectively, to change the circuit operation from a constant current regardless of the input voltage (peak, average, etc.) within reasonable limits to a circuit operation that responds to input values and in particular the input voltage whether the peak, average or some combination of such values, etc. Such a dimming operation may have multiple states and conditions, for example, there could be four choices to select from: dimming in a range of lower voltages (i.e., 90 to 125 VAC or a more narrow range, etc.), universal input with constant current or constant voltage, dimming in a range of higher voltages (i.e., 200 to 220 VAC, 220 to 240 VAC, or a more narrow range, etc.), or dimming over a large range such as 80 VAC to 305 VAC. Although a typical application may use AC, the input voltage could be AC and/or DC.

Such a dimming to universal control may be hardwired into the present invention, be software selectable, be programmed either internally or externally by any method including wireless, wired, optical control, etc., by a switch of any type, either located on the actual light source or elsewhere, by either simple or complex control algorithms, either contained internally within the light source or remote from the light source. The present invention can be implemented in a dimming to constant output mode, a universal dimmer, and numerous other embodiments and implementations that, again, can be manually switched from one mode to another, automatically switched from one mode to another, programmed by a variety of ways including by firmware, hardware, software, wired communications, wireless communications, etc.

In addition, a fast or extremely fast over current, over voltage control signal or signals may be used to limit any parameter or combination of parameters such as voltage, current, power in an instantaneous method and approach to protect the light source from, for example, transients, surges, over-voltages, harmonics, other distortions, etc. that may exist on the line input voltage, from time to time or continuously. Such fast methods of control may or may not preserve the high power factor and may depend on the characteristics and behavior of the input signal; however, in general, preserving the power factor is preferred.

An example of how to implement the present invention can be realized by providing a reference signal, for example, a reference voltage or current that can be varied with the average or instantaneous input voltage until a maximum level after which the reference voltage or current reaches a maximum level resulting, for example, in a constant output current or constant output voltage that is now independent of, for example, the input voltage and becomes a/transforms, for example, the light source into a constant output light independent of the input waveforms, levels, etc. above a certain prescribed (but also potentially programmable) input level(s) and associated conditions.

Such a reference signal may consist of, for example, a voltage divider voltage that is directly related to, for example, the peak, instantaneous, average, etc. voltage of the input which can be clamped/clipped/limited to a maximum value, by any means. Examples of such clamping/clipping/limiting/etc. can be a Zener diode in parallel with one of the resistors used in a voltage dividing network, the current obtained from a series pass transistor circuit either in a current mirror or other configuration, reaching the rail voltage of an operational amplifier or other such active device, reaching the maximum duty cycle of a digitally controlled signal, reaching the maximum pulse width modulation (PWM), reaching the maximum of an analog and/or digital signal, etc.

Such a dimmer to universal system may be used for other types of loads other than lighting and could include, for example, motors, fans, heaters, and a relatively vast collection of varied and diverse loads and applications.

The present invention can be configured in numerous and diverse ways, methods, topologies, approaches, etc. ranging from simple to extremely complex. Buck, boost, boost-buck, buck-boost, CUK, SEPIC, discontinuous conduction mode, critical conduction mode, continuous conduction mode, forward converters of any type including, but not limited to, push-pull, single, double, current mode, voltage mode, current fed, voltage fed, etc., resonant circuits, etc. can all be used to implement the present invention and the present invention can be used with all of these to realize dimmable to constant output power supply/driver performance.

As mentioned above, the present invention can be implemented in a number of power supply and driver circuits, including in general, but not limited to, buck, boost, buck-boost, boost-buck, single stage, two stage, fly back, Ćuk, forward converters, etc., power supplies, both with and without power factor correction, etc. Such dimming to universal control can be accomplished in both isolated and non-isolated designs and implementations, including on the output side and/or the input side of the circuit. The present invention can involve having appropriate time constants on the input side and/or the output side and monitoring and controlling one or more signals.

The present invention may involve one or more time constants and control loops to accomplish and implement the dimming to universal voltage input control. It may involve any combination of time constants, delays, fast and ultrafast response circuits whether digital or analog in nature. The present invention may use circuitry to limit or modify, for example, a pulse that drives a transistor to provide either isolated (e.g., transformer) or non-isolated (e.g. inductor) power transfer to output load or it may, for example, digitally modulate, turn on/off, (pulse width modulate) PWM the pulse to the transistor associated with the transformer, inductor, etc. The present invention includes all types of transformer topologies found in both switching and linear power supplies including, but not limited to, flyback, forward converters and same primary/secondary polarity transformer configurations and topologies.

The present invention can be implemented using constant on time, constant off time, constant frequency/period, constant pulse width, constant duty cycle, or, if preferred, variable on-time, off-time, frequency, etc. can be used to realize and implement the present invention. In addition, dither can be employed to reduce the effects of electromagnetic interference (EMI).

The present invention may use algorithms of any type or form to determine the minimum and maximum phase angles of, for example, triac and other types of forward and reverse phase angle/phase cut dimmers and map these to the corresponding minimum and maximum outputs, respectively, of the dimmable driver/power supply including but not limited to, for example, the minimum and maximum output currents or the minimum and maximum output voltages. The mapping may be of any desired form and can include a minimum of zero output or any other value of output up to the maximum output; likewise, the maximum output can be any output up to the maximum that the driver/power supply is designed to provide. The relationship between the input phase angle/phase cut of the triacs or other forward/reverse dimmers may essentially be of any form, equation, algorithmic expression/relation/connection and may include, but is not limited to, linear, square, square root, exponential, logarithmic, power law, look-up function, look up table, user input, etc., preprogrammed response, standard curve response, including, but not limited to National Electrical Manufacturers Association (NEMA) solid state lighting (SSL) 6 Solid State Lighting for Incandescent Replacement Dimming Standard and additional NEMA standards, including, for example, NEMA 7A and other dimming standards, documents, specifications, curves, new standards, standards yet to developed or implemented, etc. Embodiments of the present invention allow for user input and/or field installable dimming curves, functions, relations, etc. to be added at any time including a later date than manufacturing so as to be able to update, modify, adapt, change, correct, enhance, etc. curves, algorithms, functions, look up tables, etc. Embodiments and implementations of the present invention can be taught and learn about the dimmer that is being used in conjunction with the present invention to adapt to, conform with, enhance performance, provide full dimming range, provide customized dimming range, performance, provide personalized dimming range with the parameters and specifications of many person/personalities being able to be optionally stored and recalled, provide preferred settings, etc. An example simple method/algorithm of embodiments of the present invention being taught is to set the dimmer to maximum and have the present invention note the maximum phase angle and then set the dimmer to minimum and have the dimmer note the minimum phase angle and then store and use this information to set the appropriate output levels which, for example, could correspond to the minimum and maximum output of the present invention or, in other cases and examples, any other values set by, for example, the user.

Notably, the digital dimmable driver can be used with color changing fluorescent lamp replacements including RGB (red, green blue) and WRGB (white, red, green, blue) fluorescent lamp replacements. For example, in some embodiments, a separate dimmable/controllable driver is provided for each of a number of differently colored lighting elements in a fluorescent lamp replacement. The colors or the lighting elements are not limited to any particular colors, and can include bright white, daylight white, soft white, and other various temperatures of white, as well as non-white colors.

Referring now to FIG. 1, a block diagram of an embodiment of a universally digital dimmable driver/power supply or universal dimmable driver is shown is shown. In this embodiment, the universal dimmable driver is powered by an AC input 102, for example by a 50 or 60 Hz sinusoidal waveform of 120 V or 240 V RMS such as that supplied to residences by municipal electric power companies. It is important to note, however, that the universal dimmable driver is not limited to any particular voltage, current or power input, and that the universal dimmable driver and, for that matter, the universal dimmer may be adapted to operate with any input voltage or with various different input voltages including DC input voltages. The universal dimmable driver may be adapted to dim, that is, provide increasing output current as the input voltage (or, for example, the average of the input voltage or the averaged input voltage) increases, up to a certain maximum output current, at which point the output current will remain substantially constant as the input voltage continues to increase. In another embodiment, the universal dimmable driver may be adapted to sense which of a number of input voltages or input voltage ranges are applied and to switch the dimming range dynamically. In still another embodiment, the universal dimmable dimmer may be adapted to sense the on-time of, for example, phase dimmers such as Triacs and the likes, using both forward and reverse phase dimming, to provide a universal dimming driver behavior that is independent of the actual AC (or DC) input voltage up to a predetermined maximum (for example, phase dimming of the output current from less than 100 V AC up to 277 V AC after which the output current remains at a constant value). Such detection of dimming levels can be performed in a dimming detector 114, which in some embodiments, for example, detects the phase angle of a dimmer supplying the AC input 102.

The AC input 102 is connected to, in general, an EMI filter and a rectifier 104 to rectify and invert any negative voltage component from the AC input. Although the rectifier may filter and smooth the power output if desired to produce a DC signal, this is not necessary and, for example, the power output may be a series of rectified half sinusoidal waves at a frequency double that at the AC input 12, for example 120 Hz. A converter 106, such as a buck or boost-buck, etc., converter, can be used to convert the power output from the rectifier 104, and in some embodiments, includes a variable pulse generator for regulation control. Such a variable pulse generator is powered by the power output from the AC input 102 and rectifier 104 to generate a train of pulses to, for example power and drive a buck, boost-buck, buck-boost, boost, fly-back, forward converter, etc. The variable pulse generator may be adapted to enable the universal dimmable driver to operate with various different input voltages or input voltage ranges, either monitoring the input voltage and dynamically selecting appropriate dimming ranges, or by limiting the maximum output current regardless of input voltage. The variable pulse generator may comprise any device or circuit now known or that may be developed in the future to generate a train of pulses of any desired shape. For example, the variable pulse generator may comprise devices such as comparators, amplifiers, oscillators, counters, frequency generators, ramp circuits and generators, digital logic, analog circuits, application specific integrated circuits (ASIC), microprocessors, microcontrollers, digital signal processors (DSPs), state machines, digital logic, field programmable gate arrays (FPGAs), complex logic devices (CLDs), timer integrated circuits, digital to analog converters (DACs), analog to digital converters (ADCs), etc.

The pulse width of the train of pulses may be controlled by a load current detector having 0, 1 or more time constants depending on the specifics of the driver implementations. In one embodiment, the load current detector does not begin to restrict the pulse width until the current through the load has reached a maximum allowable level. Various implementations of pulse width control including pulse width modulation (PWM) by frequency, analog and/or digital control may be used to realize the pulse width control. Other features such as soft start, delayed start, instant on operation, etc. may also be included if deemed desirable, needed, and/or useful. An output driver 110 produces a current through the load 112 using, for example, a square- or sine-wave stage which can be of any type including, current, voltage, resonant, etc., with the current level adjusted by the dimming detect being fed to the control unit that controls either or both the pulse generator and/or the square- or sine-wave stage.

Figure 2:
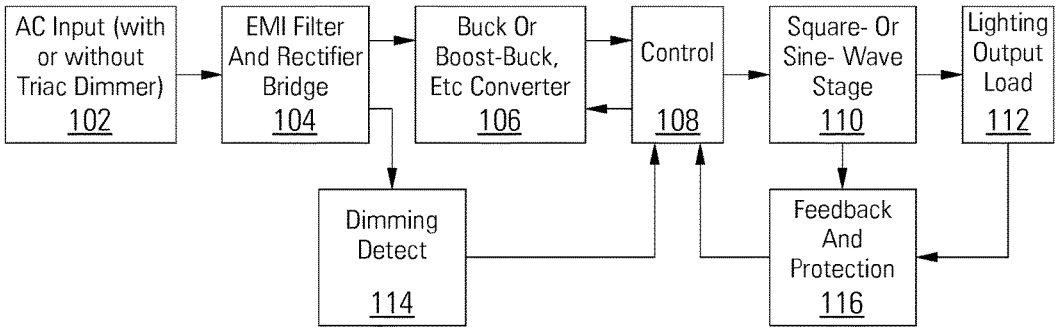
FIG. 2 depicts a block diagram of a universal digital dimmer power supply/driver including a square or sine wave stage with feedback and protection in accordance with some embodiments.

In FIG. 2, the current through the load is monitored by the load current detector which is part of the Feedback and Protection 116 of the embodiment depicted in FIG. 2. The current monitoring performed by the load current detector may be done with one or more time constants if desired that includes information about voltage changes at the power output of the rectifier slower than or on the order of a waveform cycle at the power output, but not faster changes at the power output or voltage changes at the output of the variable pulse generator. The control signal from the load current detector to the variable pulse generator thus varies with slower changes in the power output of the rectifier, but not with the incoming rectified AC waveform or with changes at the output of the variable pulse generator due to the pulses themselves. In other embodiments, the control can consist of and/or include one or more of a microcontroller, a microprocessor, a digital signal processor, FPGAs, CLDs, ASICs, digital and/or analog integrated circuits, other integrated circuits, digital to analog converters (DACs), analog to digital converters (ADCs), etc., combinations of these, etc. to control the universal digital dimmable driver with or without time constants and other control and feedback features and elements. In one particular embodiment, the load current detector includes one or more low pass filters to implement the time constant used in the load current detection. The time constant may be established by a number of suitable devices and circuits, and the universal dimmable driver is not limited to any particular device or circuit. For example, the time constant may be established using RC circuits arranged in the load current detector to form low pass filters, or with other types of passive or active filtering circuits. The load may be any desired type of load, such as a light emitting diode (LED) or an array of LEDs arranged in any configuration, a fluorescent lamp (FL) or array of FLs arranged in any configuration, CCFLs, FLs, high intensity discharge (HID) lamps, CFLs, etc. For example, an array of LEDs may be connected in series or in parallel or in any desired combination of the two. The load may also be an organic light emitting diode (OLED) in any desired quantity and configuration. The load may also be a combination of different devices if desired, and is not limited to the examples set forth herein. Hereinafter, the term LED is used generically to refer to all types of LEDs including OLEDs and is to be interpreted as a non-limiting example of a load. The time constants can be located in a number of ways and places in the circuit including on the input side or the output side or both. There may only be fast or no time constant circuits, only time constant circuits on the input side, only time constant circuits on the output side, no time constants, or any combination including combinations of the above. Comparators may be used instead of operational amplifiers or operational amplifiers may be used in the present invention.

Some embodiments of the universal dimmer may include current overload protection and/or thermal protection. As an example, the current overload protection measures the current through the universal dimmer power supply/driver and narrows or turns off the PWM pulses at the output of the variable pulse generator if the current exceeds a threshold, maximum, limit, etc. value. (The universal digital dimmer power supply/ballast/driver is also referred to herein simply as a universal dimmable driver.) The current detection for the current overload protection may be adapted as desired to measure instantaneous current, average current, or any other measurement desired and at any desired location in the universal dimmer. Thermal protection may also be included to narrow or turn off the pulses at the output of the variable pulse generator if the temperature in the universal dimmable driver becomes excessive, thereby reducing the power through the universal dimmable driver and allowing the universal dimmable driver to cool. The thermal protection may also be designed and implemented such that at a prescribed temperature, the pulses are turned off which effectively disables the power supply and turns off the output to the load. The temperature sensor can be any type of temperature sensitive element including semiconductors such as diodes, transistors, etc. and/or thermocouples, thermistors, bimetallic elements and switches, etc.

Figure 3:
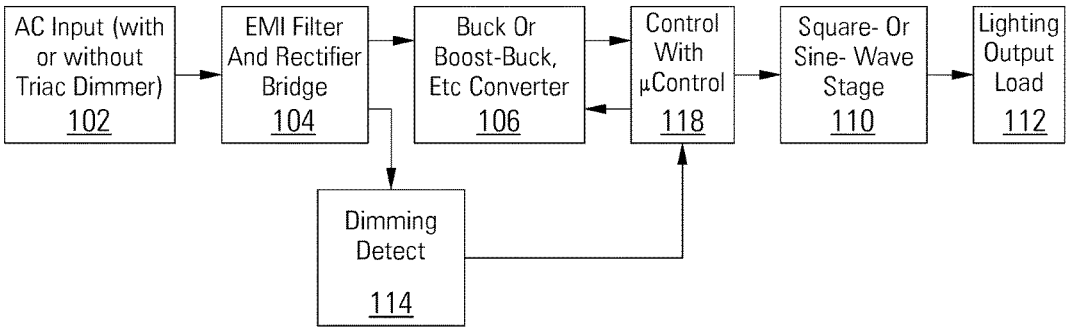
FIG. 3 depicts a block diagram of a universal digital dimmer power supply/driver including a square or sine wave stage with a microcontroller used as a controller including the dimming controller in accordance with some embodiments.
Figure 4:
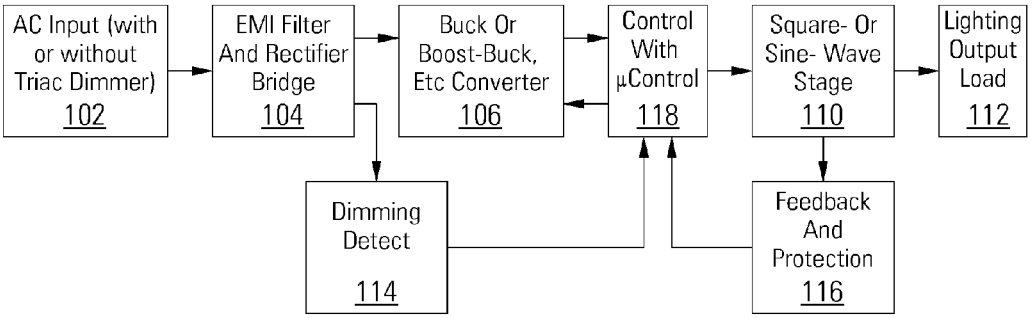
FIG. 4 depicts a block diagram of a universal digital dimmer power supply/driver including a square or sine wave stage with a microcontroller used as a controller including the dimming controller with feedback and protection in accordance with some embodiments.
Figure 5:
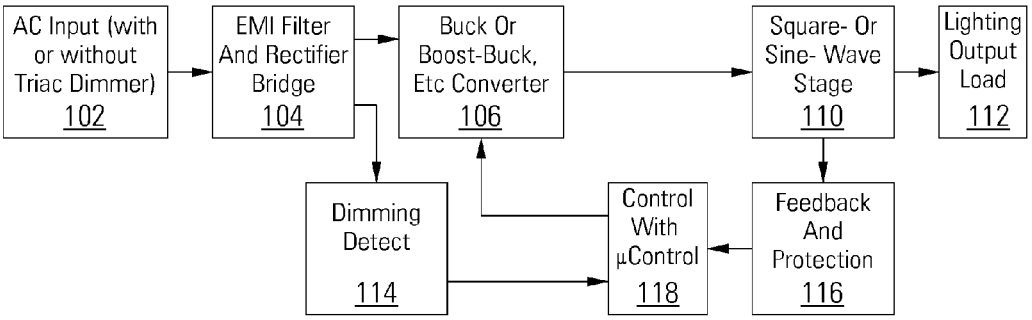
FIG. 5 depicts a block diagram of a universal digital dimmer power supply/driver including a square or sine wave stage with a microcontroller used as a controller including the dimming controller with feedback and protection in accordance with some embodiments.
Figure 6:
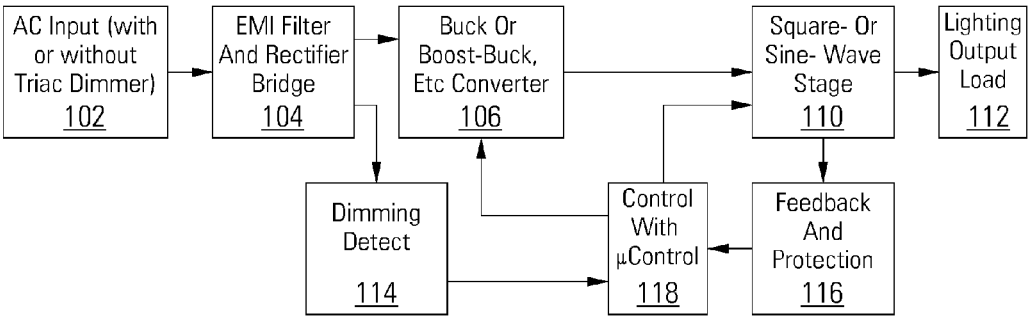
FIG. 6 depicts a block diagram of a universal digital dimmer power supply/driver including a square or sine wave stage with a microcontroller used as a controller including the dimming controller with feedback and protection with additional feedback and control paths in accordance with some embodiments.
Figure 7:
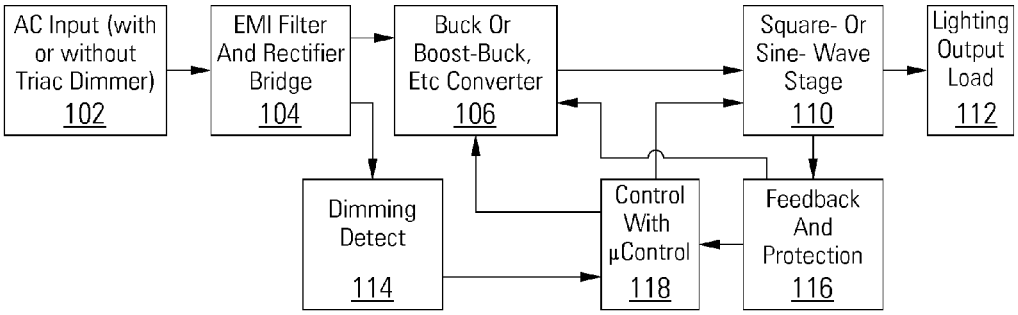
FIG. 7 depicts a block diagram of a digital dimmer power supply including a square or sine wave stage with a microcontroller used as a controller including the dimming controller with feedback and protection with additional alternate feedback and control paths in accordance with some embodiments.
Figure 8:
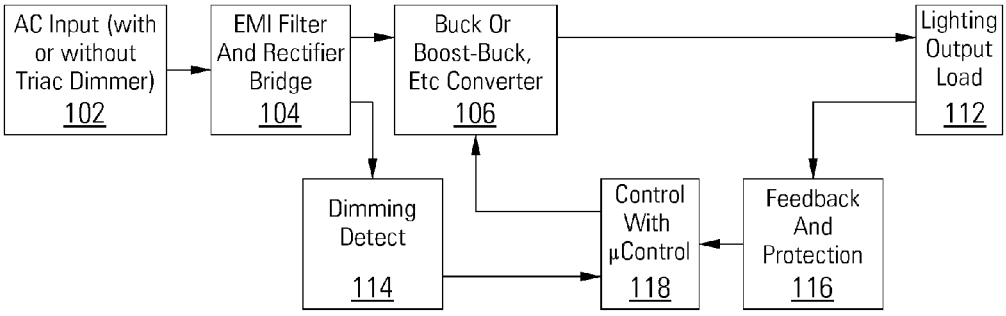
FIG. 8 depicts a block diagram of a universal digital dimmer power supply/driver with a microcontroller used as a controller including the dimming controller with feedback and protection with feedback and control in accordance with some embodiments.
Figure 9:
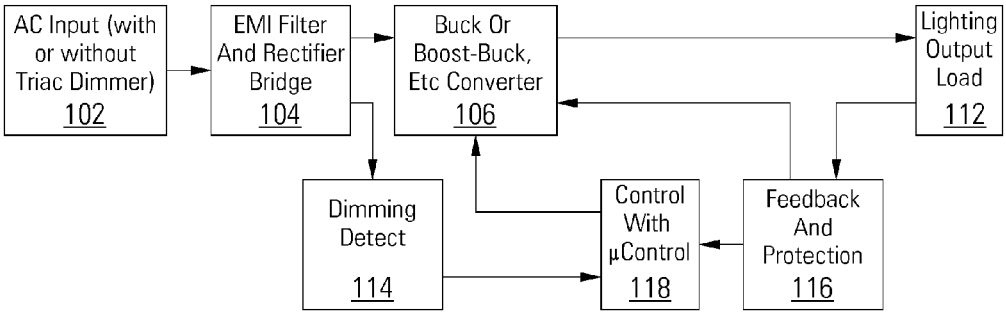
FIG. 9 depicts a block diagram of a universal digital dimmer power supply/driver with a microcontroller used as a controller including the dimming controller with additional feedback and protection with feedback and control paths in accordance with some embodiments.

As discussed above, the universal dimmer may be powered by any suitable power source, such as the AC input 12 and rectifier of FIGS. 1 through 9, or a DC input. Time constants in the universal dimmer 10 are adapted to produce pulses in the output of the variable pulse generator having a constant width across the input voltage waveform from a rectified AC input, thereby maintaining a good power factor, while still being able to compensate for slower changes in the input voltage to provide a constant load current. Any of the embodiments shown in FIGS. 1 through 9 may have feedback/detection/sensing (e.g., 116) from the load to one or more blocks of the embodiments depicted in these figures including, but not limited to, the control unit. FIG. 3 illustrates a block diagram of the present invention where the control uses a microcontroller 118 (which could also be replaced or augmented with a microprocessor, DSP, ASIC, IC, FPGA, CLD, DAC, ADC, etc.). FIGS. 4 through 9 depict variations of various block diagram embodiments of the present invention using a microcontroller (or equivalent such as a microprocessor, DSP, ASIC and/or IC with embedded capabilities, etc., combinations of these, etc.).

Figure 10:
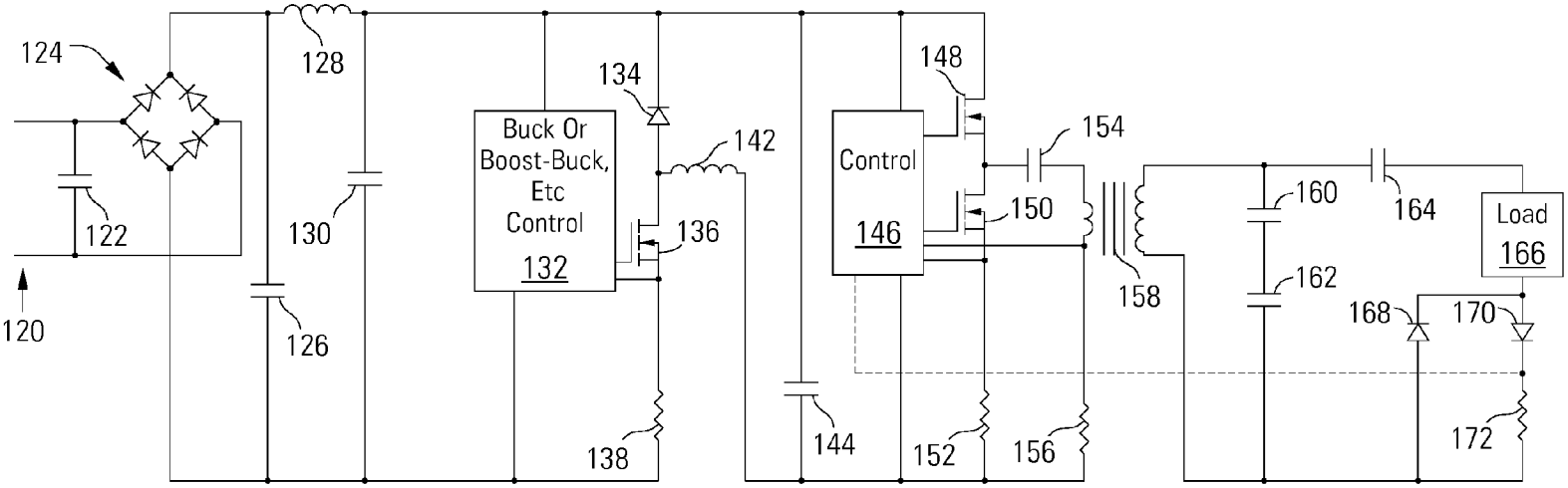
FIG. 10 depicts a schematic of one example of a universal digital dimming driver in accordance with some embodiments.
Figure 11:
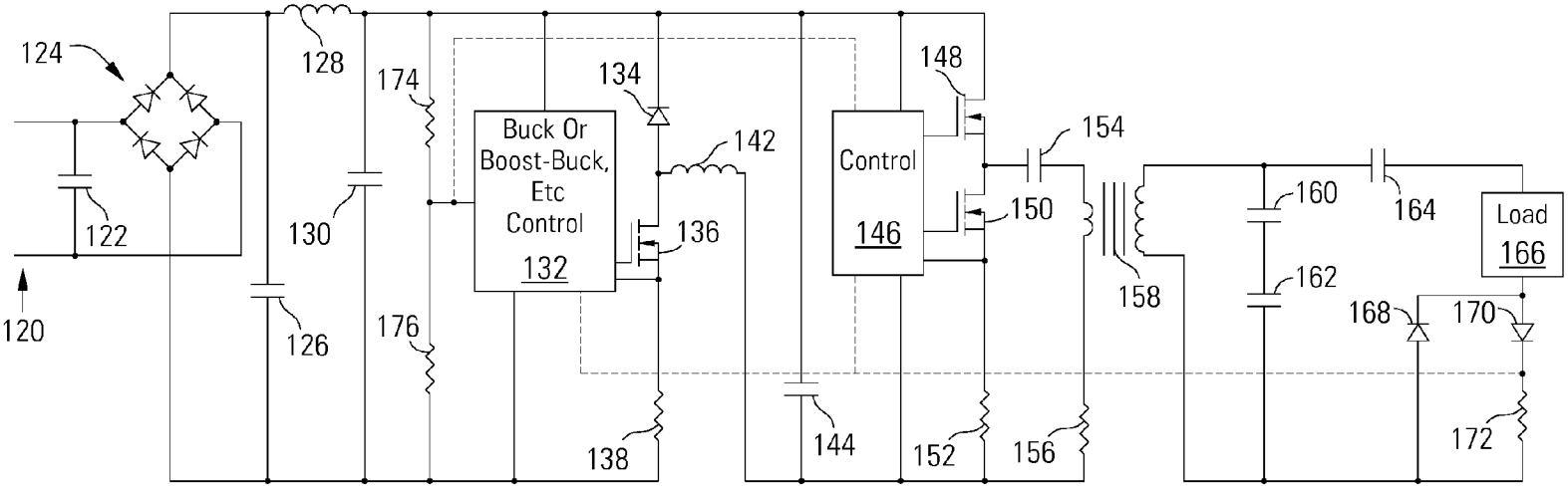
FIG. 11 depicts a schematic of one example of an universal digital dimming driver including a square or sine wave stage with additional feedback inputs in accordance with some embodiments.
Figure 12:
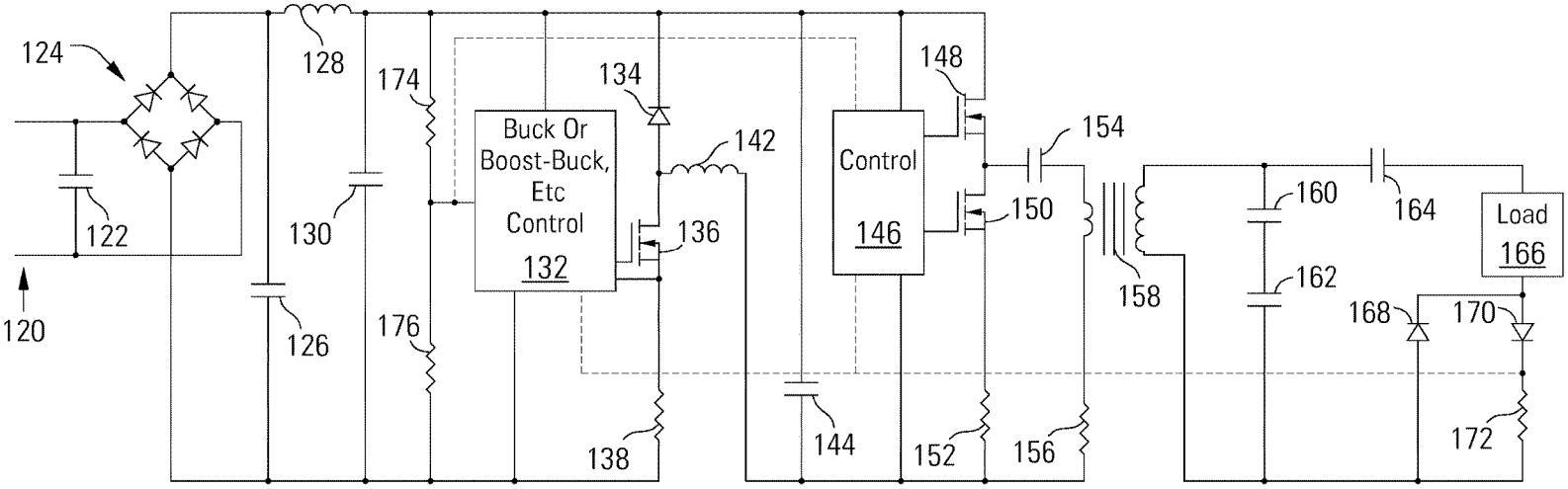
FIG. 12 depicts a schematic of one example of an universal digital dimming driver including a square or sine wave stage with feedback inputs in accordance with some embodiments.

Referring now to FIG. 10, the universal dimmable driver will be described schematically. In the diagram of FIG. 10, the load 166 is shown on the right side as part of the output for convenience in setting forth the connections in the diagram. An AC input 120 is connected to the universal dimmable driver in this embodiment through, in general, a fuse and an electromagnetic interference (EMI) filter (shown as capacitors 126, 130 and inductor 128; however any suitable EMI filter of any type may be used in place of or in addition to capacitors 126, 130 and inductor 128). The fuse may be any device suitable to protect the universal dimmable driver from overvoltage or overcurrent conditions, such as a traditional meltable fuse or other device (e.g., a small low power surface mount resistor), a circuit breaker including a solid state circuit breaker, etc. The EMI filter may be any device, devices, components, combination of components, etc. suitable, for example, to prevent EMI from passing into or out of the universal dimmable driver, such as a coil, inductor, capacitor (e.g., 122) and/or other components and/or any combination of these, or, also in general, a filter, etc. The AC input 120 is rectified in a rectifier 124 as discussed above. In other embodiments, the universal dimmable driver may use a DC input as discussed above. In this embodiment, for example, but not limited to, the universal dimmable driver may generally be divided into a high side portion including the load current detector and a low side portion including the variable pulse generator, with the output driver spanning or including the high and low side. In this case, a level shifter may be employed between the load current detector in the high side and the variable pulse generator in the low side to communicate the control signal to the variable pulse generator. The variable pulse generator and load current detector are both powered by the power output of the rectifier. The high side, including the load current detector, floats at a high potential under the voltage of the input voltage. A local ground is thus established and used as a reference voltage by the load current detector.

A reference current source, which may be part of the controller, supplies a reference current signal to the load current detector, and one or more current sensors such as a resistor (i.e., resistors 156, 152, 138) provides a load current signal to the load current detector 132. The reference current source may use the circuit ground or the local ground, or both, or some other reference voltage level as desired. The load current detector compares the reference current signal with the load current signal, optionally using one or more time constants to effectively average out and disregard current fluctuations due to any waveform at the input voltage and pulses from the variable pulse generator, and generates the control signal(s) to the variable pulse generator and other parts of the circuit. The variable pulse generator adjusts the pulse width of a train of pulses at the pulse output of the variable pulse generator based on the level shifted control signal from the load current detector, which is activated when the current through the load has reached a maximum level. The level shifter shifts the control signal from the load current detector which is referenced to the local ground in the load current detector to a level shifted control signal that is referenced to the circuit ground for use in the variable pulse generator. The level shifter may comprise any suitable device for shifting the voltage of the control signal, such as an opto-isolator or opto-coupler, resistor, transformer, transistors, etc. The use of an isolated level shifter such as a optocoupler or optoisolator or transformer may be desired, required and/or beneficial for certain applications whereas for other applications it may be optional or not needed or used.

The pulse output from the variable pulse generator drives a switch such as a field effect transistor (FET) 136 in the output driver. When a pulse from the variable pulse generator is active, the switch is turned on, drawing current from the input voltage, through the load path (and an optional capacitor connected in parallel with the load), through the load current sense resistor (i.e., resistors 156, 152, 138), an inductor 142, the switch 136, and a current sense resistor 138 to the circuit ground. When the pulse from the variable pulse generator is off, the switch 136 is turned off, blocking the current from the input voltage to the circuit ground. The inductor 142 resists the current change and recirculates current through a diode 134 in the driver, through the load path and load current sense resistor and back to the inductor 142. The load path is thus supplied with current alternately through the switch 136 when the pulse from the variable pulse generator is on and with current driven by the inductor 142 when the pulse is off. The pulses from the variable pulse generator have a relatively much higher frequency than variations in the input voltage, such as for example 30 kHz or 100 kHz as compared to the 100 Hz or 120 Hz that may appear on the input voltage from the rectified AC input.

Note that any suitable frequency for the pulses from the variable pulse generator may be selected as desired, with the optional time constant or time constants in the load current detector being selected accordingly to disregard load current changes due to the pulses from the variable pulse generator while tracking changes on the input voltage that are slower than or on the order of the waveform on the input voltage. Changes in the current through the load L due to the pulses from the variable pulse generator may be smoothed in the optional capacitor, or may be ignored if the load is such that high frequency changes are acceptable. For example, if the load 166 is an LED or array of LEDs, any flicker that may occur due to pulses at many thousands of cycles per second will not be visible to the eye. In the embodiment of FIG. 10, a current overload protection is included in the variable pulse generator and the controller and is based on a current measurement signal by one or more of the current sense resistor 138 connected in series with the switch 136, the current sense resistor 152 connected in series with transistors 148, 150 that form part of either a square- or sine-wave generator (square-wave generator illustrated in FIG. 10 for which the output can be filtered to produce a fundamental sine wave), and/or resistor 172 which is in series with load 166 via diode 170. If the current through the switch 136 and the current sense resistor 156 exceeds a threshold value set in parts of the current overload protection, the pulse width at the pulse output of the variable pulse generator will be reduced or eliminated until, for example, the fault condition is remedied or addressed. Similar such protection applies to the use of sensing resistors 152 and 172, respectively. The present invention is shown implemented in the discontinuous mode; however with appropriate modifications operation under continuous, resonant or critical conduction modes etc., and other modes can also be realized. FIGS. 10 through 13 depict certain embodiments associated with, for example AC output including, but not limited to, CCFLs, FLs, CFLs, high or low voltage AC output supplies, high or low current AC output supplies, high or low power AC output supplies, etc.

Figure 14:
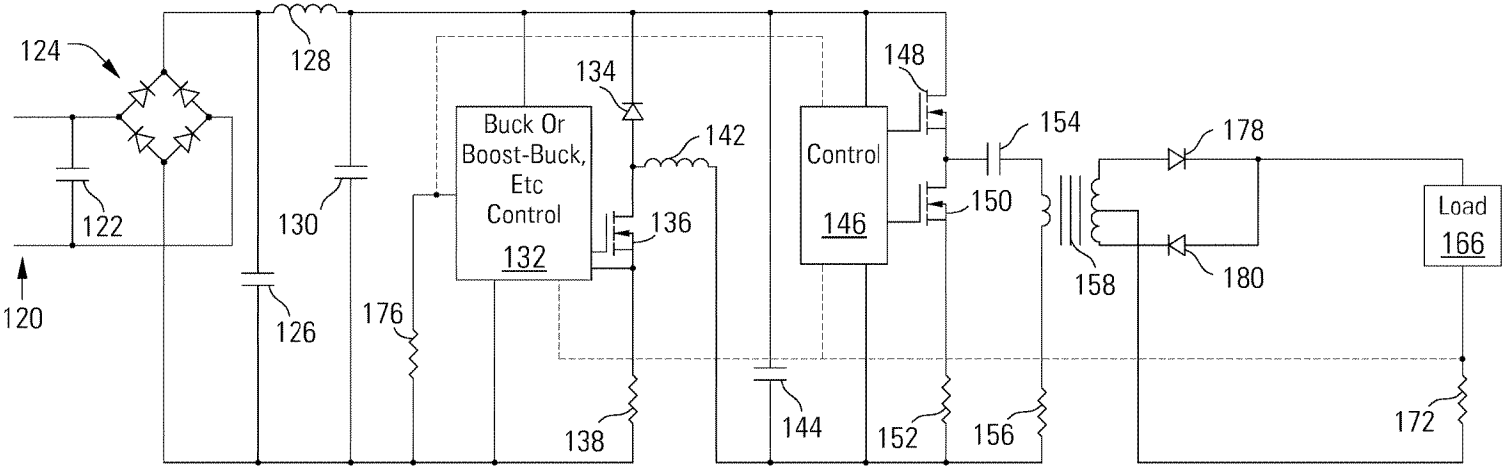
FIG. 14 depicts a schematic of one example of an universal digital dimming driver including a square or sine wave stage with dimming detection and feedback inputs and DC output in accordance with some embodiments.

Referring now to FIG. 14, a schematic of one embodiment of the universal dimmable driver will be described. In this embodiment, an AC input is used, with a resistor included as a fuse (not shown), and a diode bridge as a rectifier. Some smoothing of the input voltage may be provided by a capacitor or capacitors, although it is not necessary as described above. A variable pulse generator 132 is used to provide a stream of pulses at the pulse output. As described above, the variable pulse generator may be embodied in any suitable device or circuit for generating a stream of pulses. Those pulses may have any suitable shape, such as substantially square pulses, semi-sinusoidal, triangular, etc. although square or rectangular are the most common in driving field effect transistors. The frequency of the pulses may also be set at any desired level, such as 30 kHz or 100 kHz, or higher, etc. that enable the load current detector(s) to disregard changes in a load current due to the pulses input waveform and also realize a very high power factor approaching unity. The width of the pulses is controlled by one or more of the load current detectors (symbolically shown as resistors 138, 152, 156 in the schematic of FIGS. 14 through 16) once a maximum load current is reached, limiting the load current to the maximum even if the input voltage rises higher than needed to provide the maximum output current. For example, in one embodiment, the maximum pulse width is set at about one tenth of a pulse cycle. This may be interpreted from one point of view as a 10 percent duty cycle at maximum pulse width. However, the universal dimmable driver is not limited to any particular maximum pulse width and, for that matter, the universal power supply driver can be implemented using a constant on-time, a constant off-time, a constant period, variable on-time, variable off-time, variable period/frequency, etc.

The variable pulse generator is powered from the input voltage by any suitable means including, but not limited to, a bias circuit from the rectified AC lines, bias coils in transformers, etc. Because a wide range of known methods of reducing or regulating a voltage are known, the power supply for the variable pulse generator 132 from the input voltage is not shown in FIG. 14. For example, a voltage divider or a voltage regulator may be used to drop the voltage from the input voltage down to a useable level for the variable pulse generator.

In one particular embodiment which is not illustrated in FIG. 14, the load current detector includes an operational amplifier (op-amp acting as an error amplifier to compare a reference current (or voltage) and a load current (or voltage). The op-amp may be embodied by any device suitable for comparing the reference current and load current, including active devices and passive devices including standard comparator integrated circuits, microcontrollers, microprocessors, DSPs, ASIC, combinations of these, etc. The op-amp is referred to herein generically as a comparator, and the term comparator should be interpreted as including and encompassing any device, including active and passive devices, for comparing the reference current (or voltage) and load current (or voltage). The reference current (or voltage) may be supplied by a transistor such as bipolar junction transistor (BJT) or a MOSFET connected in series with resistor to the input voltage. Two resistors can be connected in series between the input voltage and the circuit ground, forming a voltage divider with a central node connected to the base of the BJT. The BJT and resistor act as a constant current source that is varied by the voltage on the central node of the voltage divider, which is, in turn, dependent on the input voltage. A capacitor may be connected between the input voltage and the central node to form a time constant if desired or needed for voltage changes at the central node. The universal dimmable driver in this embodiment thus responds to the average voltage of input voltage rather than the instantaneous voltage. In one particular embodiment, the local ground floats at about 3 to 15 V below the input voltage at a level established by the and the control 146 (which, again could be a microcontroller, microprocessor, DSP, ASIC, FPGA, IC, DAC, ADC, etc., combinations of these, etc) in FIGS. 14 through 16 and the load 166 in FIG. 17. A capacitor (e.g., 130) may be connected between the input voltage and the local ground to smooth the voltage powering the appropriate load current detector(s) if desired or needed. A Zener diode may also be connected between the input voltage and the central node to set a maximum load current by clamping the reference current that, for example, a BJT can provide to a reference voltage resistor. In other embodiments, for example, the load current detector may have its current (or voltage) reference derived by a simple resistive voltage divider, with suitable AC input voltage sensing, level shifting, and maximum clamp, rather than BJT.

The load current (meaning, in this embodiment, the current through the load and through a capacitor 144 connected in parallel with the load) is measured using the load current sense resistor 172. The capacitor 144 can be configured to either be connected through the appropriate sense resistor(s) or bypass the sense resistor(s). The current (or voltage) measurement is provided to an input of the error amplifier, in this case, to the non-inverting input which could be part of a digital controller. A time constant may be applied to the current measurement using any suitable device or circuit, such as the RC lowpass filter made up of a series resistor and a shunt capacitor to the local ground connected at the non-inverting input of the error amplifier. Alternatively, instead of a hardware time constant(s), a software and/or firmware time constant or constants may be used. As discussed above, if needed, any suitable hardware, software and/or firmware device or device(s) or entities for establishing the desired time constant or time constants may be used such that the load current detector(s) and/or the feedback/controller disregards rapid variations in the load current due to the pulses from the variable pulse generator and any regular waveform of the input voltage. The load current detector(s) thus substantially filters out changes in the load current due to the pulses themselves, averaging the load current (or voltage) such that the load current or voltage detector output is substantially unchanged by individual pulses at the variable pulse generator output.

In some embodiments, the reference current is measured using a sense resistor connected between a BJT and the local ground, and is provided to another input of the error amplifier, in this case, the inverting input. The error amplifier is connected as a difference amplifier with negative feedback, amplifying the difference between the load current (or voltage) and the reference current (or voltage). An input resistor is connected in series with the inverting input and a feedback resistor is connected between the output of the error amplifier and the inverting input. A capacitor is connected in series with the feedback resistor between the output of the error amplifier and the inverting input and an output resistor is connected in series with the output of the error amplifier to further establish a time constant in the load current detector. Again, the load current detector may be implemented in any suitable manner to measure the difference of the load current (or voltage) and reference current (or voltage), with a time constant or time constants being included in either or both the load current detector or the digital controller such that changes in the load current due to pulses are disregarded while variations in the input voltage other than any regular waveform of the input voltage are tracked.

The output from the error amplifier may be connected to the level shifter, in this case, an opto-isolator, through the output resistor to shift the output from a signal that is referenced to the local ground to a signal that is referenced to the circuit ground or to another internal reference point in the variable pulse generator. In certain embodiments, a Zener diode and a series resistor (i.e., diode 182 and resistor 184, respectively in FIGS. 15 and 16) may be connected between, for example the output voltage and the input of any suitable point including but not limited to the level shifter for overvoltage protection. In other embodiments a resistive divider and/or a capacitive divider such as capacitors 160, 162 in FIGS. 10 through 14 may be used, for example, as both a voltage monitor/control and as a voltage overprotection sense. If the voltage across load rises excessively, the Zener diode 182 will conduct, turn on, for example, a level shifter and reduce the pulse width or stop the pulses from the variable pulse generator. In this type of embodiment, there are thus two parallel control paths, the error amplifier to the level shifter and the overvoltage protection Zener diode to the level shifter.

The error amplifier in this particular type of embodiment operates in, for example, an analog mode. During operation, as the load current rises above the reference current establishing the maximum allowable load current, the voltage at the output of the error amplifier increases, causing the variable pulse generator to reduce the pulse width or stop the pulses from the variable pulse generator. As the output of the error amplifier rises, the pulse width becomes narrower and narrower until the pulses are stopped altogether from the variable pulse generator. The error amplifier produces an output proportional to the difference between the average load current (or voltage) and the reference current (or voltage), where the reference current (or voltage) may be in some embodiments proportional to the average input voltage. In other embodiments of the present invention, the current may be tracked pulse-by-pulse and control and feedback applied accordingly via digital and/or analog control including using a microcontroller, microprocessor, DSP, ASIC, IC, etc., combinations of these, etc.

As discussed above, pulses from the variable pulse generator turn on the switch 136, in this case a power FET typically via a resistor to the gate of the FET 136. This allows current to effectively flow through the load 166 and other components including capacitors, through, for example, load current sense resistor(s), the inductor 142, the switch 136 and through, for example, current sense resistor 138 to circuit ground. In between pulses, the switch 136 is turned off, and the energy stored in the inductor 142 when the switch 136 was on is released to resist the change in current. The current from the inductor 142 then flows through the diode 134 and back through the load square- or sine-wave stage in FIGS. 10 through 16.

In other embodiments, for example, resistors or capacitors can operate as a voltage divider, which often can result in omitting other active devices and associated components.

Generally, current sense resistors 138, 152, 156 may have low resistance values in order to sense the currents without substantial power loss. Thermal protection may also be included in the variable pulse generator or other parts of the circuit including the controller and digital controller, narrowing or turning off the pulses if the temperature climbs or if it reaches a threshold value, as desired. Thermal protection may be provided in the variable pulse generator in any suitable manner, such as using active temperature monitoring, or integrated in the overcurrent protection by gating a BJT or other such suitable devices, switches and/or transistors with the current feedback signal, where, for example, the BJT exhibits negative temperature coefficient behavior. In this case, the BJT would be easier to turn on as it heats, making it naturally start to narrow the pulses.

In one particular embodiment one or more of the load current detectors turn on the output to narrow or turn off the pulses from the variable pulse generator, that is, the pulse width is inversely proportional to the load current detector output. In other embodiments, this control system may be inverted so that the pulse width is directly proportional to the load current detector output. In these embodiments, the load current detector(s) is/are turned on to widen the pulses. This pulse widening may be used in applications where this feature is desirable. In additional embodiments, the load current may vary as the phase angle/on-time (or conversely, the off-time) of the Triac or other forward or reverse dimmer.

In applications where it is useful or desired to have isolation between the load and the input voltage source, a transformer can be used in place of the inductor. However, example embodiments depicted, for example, in FIGS. 10, 11, 13, 14 and 16, the output is isolated by transformer 158 which may or may not be center tapped, may or may not have multiple taps, may or may not have one or more biases/secondaries/auxiliary outputs/fan outputs, etc. The transformer can be of essentially any type including toroidal, C or E cores, or other core types and, in general, should be designed for low loss. The transformer can have a single primary and a single secondary coil or the transformer can have either multiple primaries and/or secondaries or both including one or more bias and/or auxiliary coils to provide power to various parts of the dimmer power supply driver. In addition, high voltage transformers may also be used with the present invention. Some embodiments may use a transformer in the flyback mode of operation to realize an efficient circuit with, for example, very high power factor approaching unity and with isolation between the AC input and the LED output. Such an embodiment can also readily support internal dimming. For version and embodiments of the present invention that use inductors, including, but not limited to those shown in FIGS. 10 through 17, one or more tagalong inductors may be used to, among other things, improve efficiency. A non-limiting example of such tagalong inductors is disclosed in U.S. patent application Ser. No. 13/674,072 entitled "Dimmable LED Driver with Multiple Power Sources", filed Nov. 11, 2012, the entirety of which is incorporated herein by reference for all purposes.

Referring now to an isolated embodiment of the present invention, a power supply with a transformer will be described. An AC input is assumed, and is connected to the universal dimmable driver in this type of embodiment typically through a fuse and an electromagnetic interference (EMI) filter. As in previously described embodiments, the fuse may be any device suitable to protect the universal dimmable driver from overvoltage or overcurrent conditions. The AC input is rectified typically in a rectifier bridge. In other embodiments, the universal dimmer may use a DC input. The universal dimmer may, in this illustrative example embodiment, generally be divided into a high side portion often including the load current detector and a low side portion including the variable pulse generator. However certain embodiments of the present invention can use, for example, gate transformers or high speed optocouplers/optoisolators such that variable pulse generator resides on the high side of the transformer. Usually the high side portion is connected to one side of the transformer, such as the secondary winding, and the low side portion is connected to the other side of the transformer, such as the primary winding. A level shifter and, depending on the implementation and application, isolator is employed between the load current detector in the high side and the variable pulse generator in the low side to communicate the control signal to the variable pulse generator. The high side has a node that may be considered a power input for the output, although the power for the power input is derived in this embodiment from the transformer. The load receives power from the power input. The load current detector is also powered from the power input (although an additional bias coil could be used on the transformer to provide this power and voltage) in some embodiments through a resistor, and a reference current (or voltage) for the load current (or voltage) detector is generated by a voltage divider having, for example, at least two resistors or in some embodiments, capacitors or other elements connected in series between the power input and a high side or local ground. The variable pulse generator is powered from a low side input voltage through a resistor, for which another bias coil could also be used if so desired, and a switch driven by pulses from the variable pulse generator turns on and off current through the transformer. The power supply voltage to the load current detector may be regulated in any suitable manner, and the reference current (or voltage) input may be stabilized as desired. For example, a voltage divider with a clamping Zener diode may be used as in previous embodiments, a precision current source may be used in place of the resistor in the voltage divider, a bandgap reference source may be used, etc. Note that it is important in dimmable embodiments for the input voltage to be a factor in the reference current input such that this input is clamped at some maximum value as the input voltage rises, yet is allowed to fall as input voltage drops (suitably filtered to reject the AC line frequency) for use in, for example, control during dimming embodiments of either or both analog or digital controlled dimming.

In the high side, as current flows through the load, a load current sense resistor provides a load current feedback signal to the load current detector. The load current detector compares the reference current signal with the load current signal using, in the present example embodiment, a time constant to effectively average out and disregard current fluctuations due to any waveform at the power input and pulses from the variable pulse generator through the transformer, and generates the control signal to the variable pulse generator, gradually turning on the control signal as needed to cause the variable pulse generator to reduce the pulse width at the pulse output of the variable pulse generator as needed to keep the load current from rising above the maximum allowed level including the maximum allowed during dimming. In some embodiments, when the load current is below the maximum allowed level, the load current detector turns off the control signal to permit free-running dimming. The level shifter shifts the control signal from the load current detector which is referenced to the local ground by the load current detector to a level shifted control signal that is referenced to the circuit ground for use by the variable pulse generator. The level shifter may comprise any suitable device for shifting and/or isolating the voltage of the control signal between isolated circuit sections, such as an opto-isolator, opto-coupler, resistor, transformer, etc.

Figure 13:
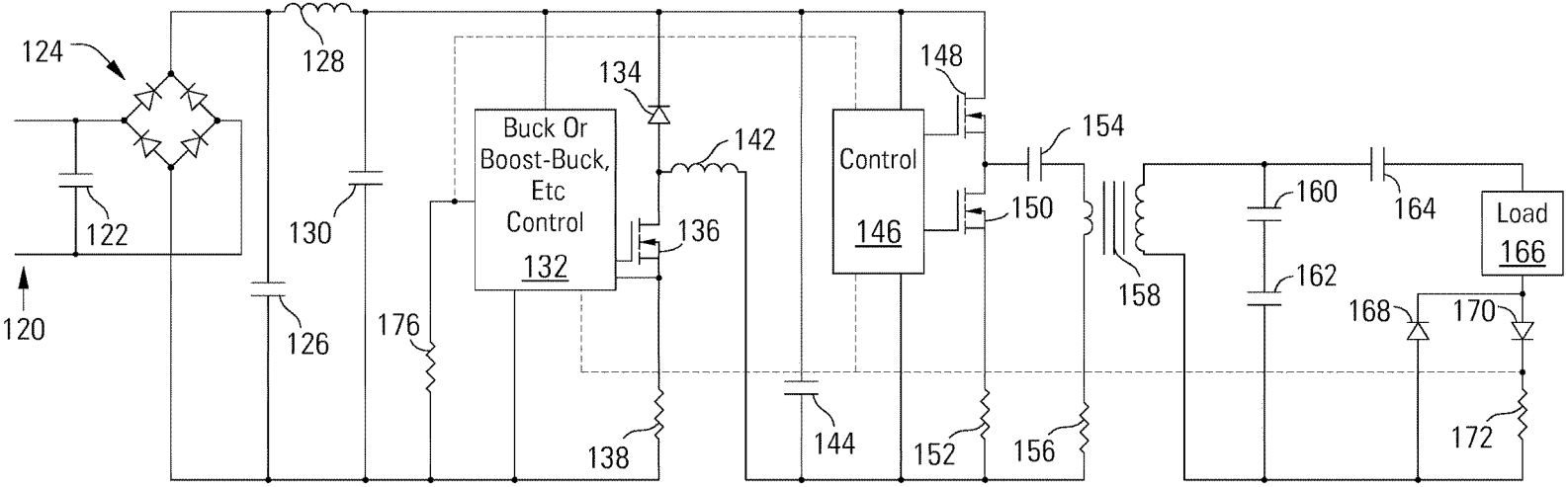
FIG. 13 depicts a schematic of one example of an universal digital dimming driver including a square or sine wave stage with alternative dimming detection and feedback inputs in accordance with some embodiments.
Figure 15:
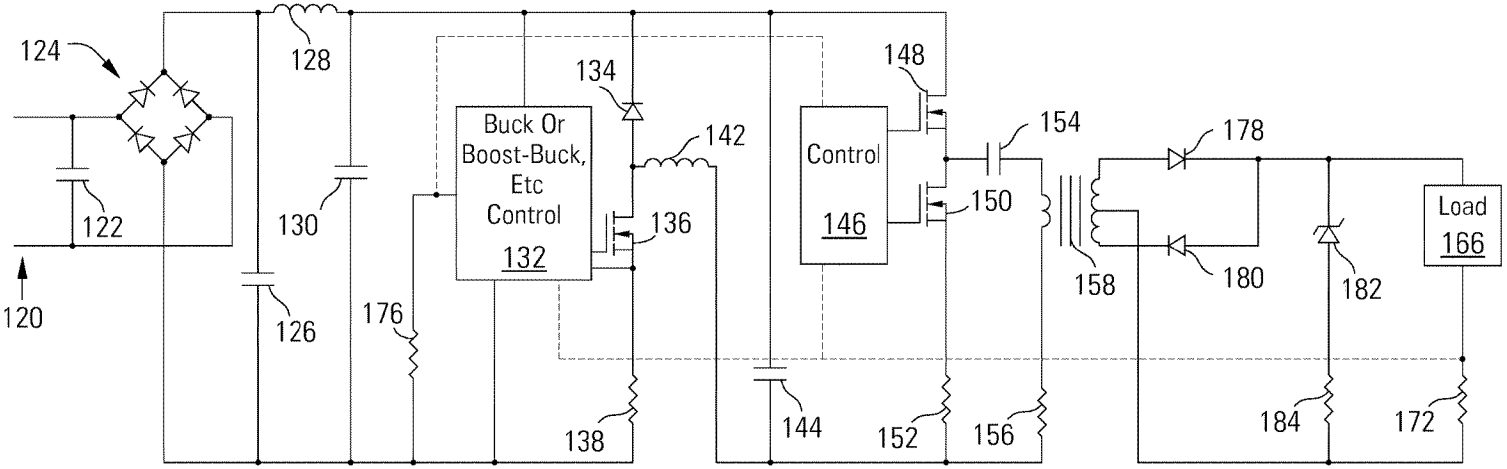
FIG. 15 depicts a schematic of one example of an universal digital dimming driver including a square or sine wave stage with alternative dimming detection and feedback inputs and DC output in accordance with some embodiments.
Figure 16:
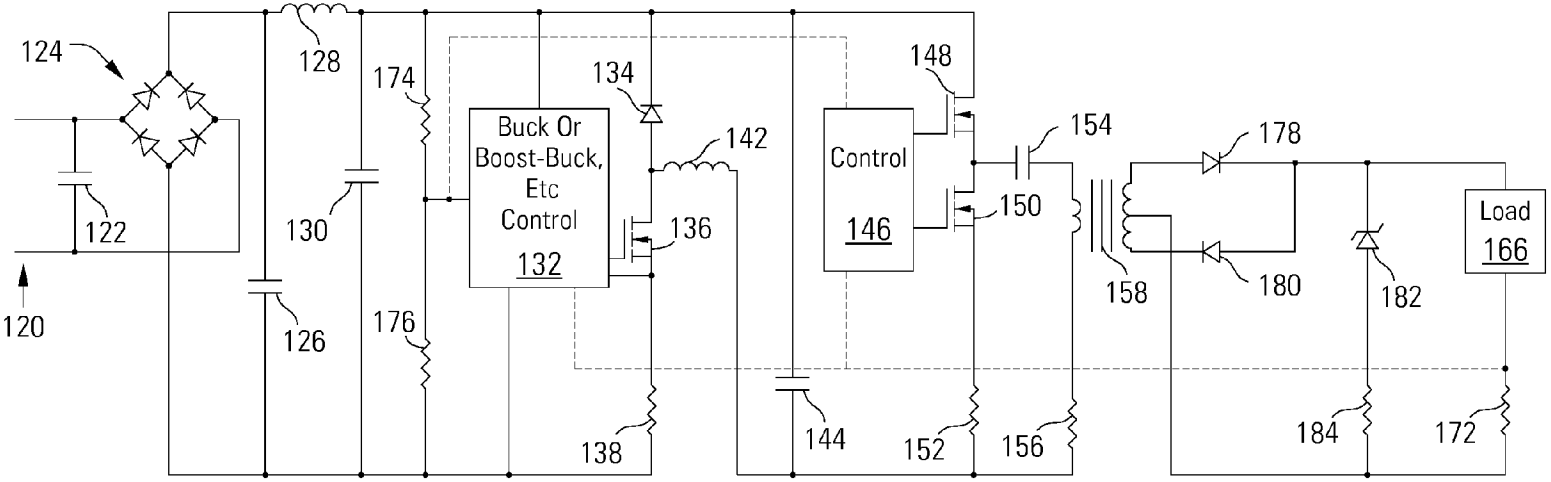
FIG. 16 depicts a schematic of one example of an universal digital dimming driver including a square or sine wave stage with dimming detection and feedback inputs and DC output in accordance with some embodiments.
Figure 17:
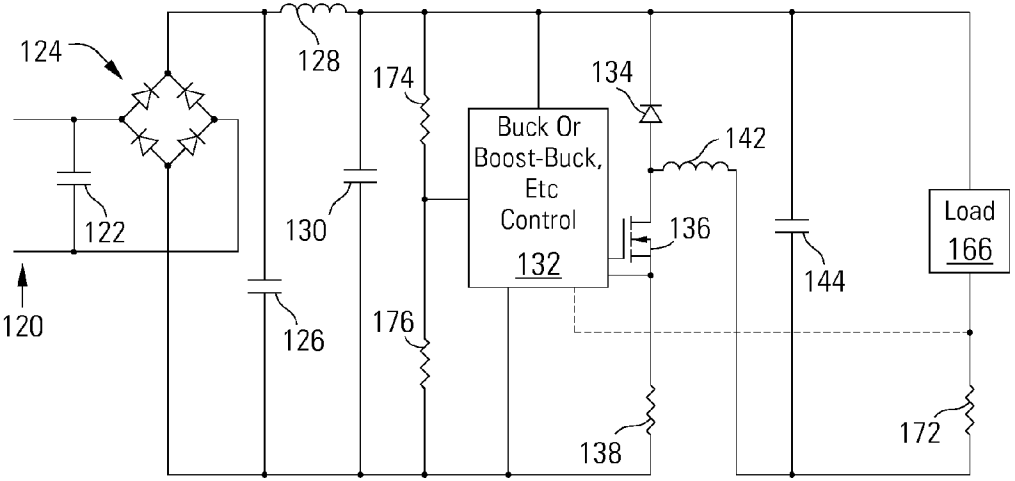
FIG. 17 depicts a block diagram of one example of a universal phase detecting digital dimmable power supply/driver in accordance with some embodiments.

The pulse output from the variable pulse generator drives the switch, allowing current to flow through the transformer and powering the high side portion of the universal dimmable driver. As in some other embodiments, any suitable frequency for the pulses from the variable pulse generator may be selected for the present embodiments shown in this figure, with the time constant in the load current detector being selected to disregard load current changes due to the pulses from the variable pulse generator while tracking changes on the input voltage that are slower than or on the order of the waveform on the input voltage. In other embodiments, the time constant can also be incorporated into the pulse generator circuit. Changes in the current through the load due to the pulses from the variable pulse generator may be smoothed in the optional capacitor, or may be ignored if the load is such that high frequency changes are acceptable. Current overload protection may be included in the variable pulse generator based on a current (or voltage) measurement signal by a current sense resistor connected in series with the switch. If the current through the switch and the current sense resistor exceeds a threshold value or limit or maximum set in the current overload protection, the pulse width at the pulse output of the variable pulse generator will be reduced or eliminated. A suitable line capacitor may be included between the input voltage and circuit including for instance on the DC side of the rectifier bridge ground to smooth the rectified input waveform if desired or this capacitor may be reduced or eliminated depending on the particular situation, application, etc. A snubber circuit or circuits as well as clamp circuits may be included in parallel, for example, with the switch or the primary inductance, respectively, if desired to suppress transient voltages in the low side circuit. It is important to note that the universal dimmable driver is not limited to the flyback mode configuration and that a transformer or inductor based universal dimmable driver may be arranged in any desired topology. In addition, the present invention can have the digitization representation of the Triac phase angle or other forward or reverse phase information fed to either (or both) the current control circuit (either on the high side or same side as the pulse generator control) or to the pulse generator control to control the width of the PWM pulse so as to adjust the output current (or in other embodiments, implementations and applications, the output voltage) so as to respond and dim accordingly to the Triac or other forward or reverse phase dimmer dimming information and signal. This includes embodiments that allow for universal dimming over an universal input voltage range. In other embodiments, analog and analog-like or a combination of analog and digital information, input and/or control can be used to achieve the universal dimmability. As can be seen in FIGS. 11 through 17, resistors 174, 176 in FIGS. 11, 12, 16 and 17 and resistor 176 in FIGS. 13, 14, and 15 are used, in conjunction with other components either not shown in the figures or incorporated into the control and feedback, including digital control as well as digital feedback of the dimming detect control during phase dimming with Triacs, Triac-based dimmers and other forward and reverse phase dimmers. Embodiments of the present invention can use some information to control the current during dimming in any manner or form deemed desirable including digitally transforming the dimming information obtained from the Triac, Triac-based, or other types of forward and reverse dimmers into a linear, sub-linear, super-linear, quadratic, power-law, square-root, logarithmic, exponential, etc. function and behavior of the load current (or voltage or, for example, power) including the current through (or the voltage across) LEDs or OLEDs and the current through (or the voltage across) CCFLs, FLs, CFLs, HIDs, etc. such as to actively control for example either or both the current or the voltage to the load.

Referring back now to FIG. 8, the power supply with a transformer which may be adapted for dimmability by providing level-shifted and/or isolated feedback from the AC input voltage to the load current detector. The level shifter may comprise any suitable device as with other level shifters and/or isolators. The level-shifted feedback enables the load current detector to sense the AC input voltage so that it can provide a control signal that is proportional to the dimmed AC input voltage. Such a proportional signal may be of any form and relationship including, but not limited to, linear, sub-linear, super-linear, square, square-root, quadratic, logarithmic, exponential, power-law, etc. as mentioned previously. In some embodiments of the present invention, the use of a level shifter may not be needed or required.

The universal dimmable driver may also include an internal dimmer capability, for example, to adjustably attenuate any of a number of reference or feedback currents (or voltages). In some embodiments, the universal dimmable driver to provide adjustable control (i.e. control during dimming) of the level of the reference current(s) (or voltage(s)). The reference current generated by the internal dimmer may be based on, for example, an embodiment as disclosed in U.S. patent application Ser. No. 13/773,407 entitled "Universal Dimmer", filed Feb. 21, 2013, the entirety of which is incorporated herein by reference for all purposes. In this example embodiment, the reference current generated by the internal dimmer is based on the input voltage in the low side or primary side of the universal dimmer via a feedback signal through the transformer, including for example, but not limited to, the instantaneous or average input voltage, the phase/on-time of the input voltage, etc. or any combination or single individual parameter. (Notably, some reference numbers herein refer to figures in U.S. patent application Ser. No. 13/773,407 which has been incorporated by reference.)

A diode may be included to ensure that current on the internal dimmer flows only in one direction, and a capacitor may be added to introduce a time constant on the internal dimmer if needed and as desired. In other embodiments, the high side and low side may be combined on either what has been referred to as the high side or what has been referred to as the low side.

One example of a variable pulse generator that supports universal dimming, although it is important to note that the variable pulse generator may be adapted in any suitable manner to limit the input voltage as needed to cap the output current given various different input voltages or input voltage ranges, is that in this example embodiment, the variable pulse generator is adapted with several mechanisms for limiting the pulse width at the pulse output. The pulse train is generated by a voltage to duty cycle pulse generator, which adjusts the duty cycle or pulse width proportionally to the voltage at the input. As the voltage increases, the pulse width or duty cycle increases. The free-running non-limited pulse width is established by a bias voltage at the input, such as that produced by divider resistors from a reference voltage. For example, a 15V reference voltage may be used with 100 kΩ and 30 kΩ resistors to produce a bias voltage at the input of about 3.5V for a maximum pulse width. Various mechanisms may be used to lower the voltage at the input during over-current or over-temperature conditions, for example using either digital and/or analog control. The values and voltages listed are merely for illustrative purposes and should not be construed as limiting in any way or form for the present invention.

One such mechanism in the example embodiment is the addition of another resistor parallel with the first slope resistor if the input voltage rises above a particular level to lower the pulse width. For example, the variable pulse generator may be adapted to operate with either a 120VAC input or a 240VAC input and to detect which is being used. By connecting a second 30 kΩ slope resistor in parallel with the first slope resistor, the voltage at the input to the pulse generator is cut in half and the rate of increase in the duty cycle slope is cut in half as the input voltage is dimmed. Note that when the input voltage is dimmed by an external dimmer, the input voltage range is typically either 0 VAC-120 VAC or 0 VAC-240 VAC. However, other examples and embodiments of the present invention can allow for wider, broader or narrower voltage ranges as desired or required, etc.

Any suitable mechanism for connecting the second slope resistor (or otherwise changing the value of the first slope resistor) may be used. For example, a microcontroller or suitable alternatives may monitor the input voltage 16 and turn on a transistor such as a NPN bipolar transistor or MOSFET to connect the second slope resistor. Such alternatives may include microprocessors, digital signal processors (DSPs), state machines, digital logic, analog and digital logic, application specific integrated circuits (ASICs), field programmable gate arrays (FPGAs), configurable logic devices (CLDs), digital to analog converters (DACs), analog to digital converters (ADCs), etc. In this example, the microcontroller monitors the input voltage using an analog to digital converter (ADC) input connected to the input voltage 16 through voltage divider resistors, which scale the expected maximum voltage of 240 VAC (rectified to about 340 VDC) at the input voltage to the maximum input level of the ADC, or about 3 VDC or a bit below. A Zener diode may be connected to the ADC to limit the input voltage to the maximum supported by the microcontroller to prevent damage to the microcontroller. When operating at 120 VAC input and dimmed fully on, the input to the ADC in the microcontroller is about 1.5 VDC. The microcontroller in this example is programmed to turn on the transistor and connect the second slope resistor when the input voltage rises above about 1.5 VDC, meaning that the AC input is above about 120 VAC. The variable pulse generator may be adapted if desired to perform this input voltage detection and secondary slope resistor switching only periodically or only at startup, and to keep the secondary slope resistor active once connected until the next power cycle, to avoid switching back and forth between input voltage ranges and flashing the LEDs. Any suitable method including hardware, firmware, software, algorithms, etc. may be used. Note that MOSFETs, junction FETs, any most any other type of transistor could be used in place of the BJT.

A similar mechanism may be used to reduce or limit the pulse width when the load current reaches its maximum allowable value. When the load current detector or detectors determines that the load current has reached the maximum value, it begins to turn on the load current control signal. The control signal may level shifted or isolated as needed by a device such as the level shifter. A third slope resistor is connected in series with the level shifter output across the first slope resistor, so that as the level shifter is activated, it lowers the effective resistance between the pulse generator input and circuit ground, reducing the voltage at the pulse generator input. The level shifter is turned on in analog fashion by the load current detector, turning on more strongly as the load current rises above the maximum allowable level. The third slope resistor is given a value low enough to turn off the pulses or restrict them as desired to protect the load from excessive current. For example, the third slope resistor may be a 1 kΩ, so that when the level shifter is only slightly turned on, the combination of the third slope resistor and the level shifter may present a 30 kΩ resistance in parallel with the first slope resistor, and when the level shifter is fully or nearly fully on, 1 kΩ is connected in parallel with the first slope resistor 456. Although primarily illustrated for two dimming input voltage ranges (N=2), any number of ranges (N=1, 2, 3, 4, 5 . . . ) may be used and selected with the present invention. In addition, the example illustrative circuit may be adapted, modified, changed, etc. to respond to and have different inputs as well as different outputs or connections for the outputs, etc.

The low side current overload protection (i.e., resistor 138 in FIGS. 10 through 17) may operate in similar fashion, for example turning on a bipolar transistor or MOSFET to connect a low resistance across the first slope resistor to turn off or restrict the pulse width at the pulse output. Note that an optional capacitor may be added to facilitate time constant implementation that can be overridden by the detection of an overcurrent condition either in the Load current path or in the AC (or DC) input current path, or by other parameters or conditions, etc. By a similar token, embodiments of the present invention can be designed and implemented that allow universal dimming based on the on-time (or off-time) phase of either a conventional Triac dimmer or a forward or reverse phase non-Triac dimmer by using the circuit in a more digital or completely digital mode in which the on-time of the dimmer is determined and the present invention dimmable power supply driver produces an output current proportional to the phase angle on-time. As mentioned previously, other relationships and functions besides linearly proportional can be used. In addition, should isolation be necessary, an optocoupler, for example, can also be configured and used in a digital on/off fashion rather than as in an analog fashion as illustrated in the embodiments and implementations shown and may also be connected to other parts of the present invention. Again, nothing in this document should be construed or viewed as limiting in any way or form for the present universal dimmer power driver invention discussed here.

For applications where the input voltage is lower such as a nominal 100 VAC or even down to 80 VAC, the point at which current control is reached can be set to a lower value such as, for example, 70 VAC or so. The universal dimmable drive may be adapted to begin turning on at any practical input voltage level desired. Of course, the description and discussion above are meant to merely illustrate some exemplary implementations and are in no way or form limiting of the present invention. Universal dimming with the present invention can be used to cover the range from below 100 VAC to greater than 480 VAC in embodiments and implementations of the present invention taught. For example, the present invention could utilize the ~100 VAC current control set point implementation to realize a universal driver in which the reference or pulse width input was modulated/changed/PWM/etc. in response to the phase angle/phase information of the Triac or other forward or reverse phase dimmer such that the output current (or output voltage) varied from 0 (or close to zero or some other value) to 100% as the Triac or other forward or reverse phase dimmer phase signal varied from complete dimming (i.e., zero percent on-time) to no dimming (i.e., 100% on-time or close to 100% on-time depending on the dimmer used). The present invention can take the phase range (i.e., minimum phase angle to maximum phase angle) of any dimmer and convert this to a minimum and maximum output, respectively, including either a local minimum and maximum output or a global minimum and maximum output. Such outputs can be, but are not limited to, selected/determined/set/preset/by any, all, a subset, etc. of the methods, ways, protocols, algorithms discussed herein. Again, the dimming response can be, for example but not limited to, linear, sub-linear, super-linear, square, square-root, power-law, logarithmic, exponential, piece-wise, essentially any function, etc, and/or any function, relation, look-up table, user input, user defined set of inputs, parameters, NEMA SSL specifications, etc.

In another embodiment of the universal dimmable driver, a microcontroller (or one of the many suitable alternatives as discussed above) controls the load current based on phase angle/duty cycle of the input voltage, rather than on a determination of when the input voltage reaches or exceeds a threshold or limit value. In this embodiment, the microcontroller (or microprocessors and/or DSPs including DSPs built in to ASICs) may, for example in some embodiments, be shifted into the secondary/load side of the universal dimmable driver to directly control the load current level based on the duty cycle on the AC input 12, as it is adjusted by an external dimmer such as a Triac based dimmer. The values of the voltage divider resistors are adapted so that they operate in conjunction with the Zener diode to present an asserted signal to the microcontroller during the "on" portion of the cycle at the AC input 12, and a logical low signal to the microcontroller (and/or microprocessors, DSP(s), etc.) during the "off" portion of the cycle at the AC input. Although the rectifier and capacitor do perform some signal conditioning as well as rectification of the AC input, the universal dimmer may be adapted to maintain enough of the original signal to detect when the AC input 12 is on and when it is off. In other embodiments of the present invention, the phase range (i.e., minimum phase angle to maximum phase angle) of any dimmer can be used to convert this phase information to a minimum and maximum output, respectively, including either a local minimum and maximum output or a global minimum and maximum output. Such outputs can be, but are not limited to, selected/determined/set/preset/by any, all, a subset, etc. of the methods, ways, protocols, algorithms, etc. discussed herein using for example a microcontroller. The microcontroller or other such control unit such as a microprocessor, ASIC, DSP, ASIC with built-in DSP, ASICs with built in microcontrollers and/or microprocessors, etc., FPGA, digital to analog converters (DACs), analog to digital converters (ADCs), etc. may be configured to produce an output signal (i.e., voltage reference signal that is further voltage divided down in an exemplary implementation) that can, for example, be proportional to the input phase on-time or can be any practical function of the input phase on-time including squared, square-rooted, power law, logarithmic, sub-linear, etc. In other embodiments, the control signals may be sent in digital format rather than in analog format. Such digital format can take the form of any type of digital signal sent both internally and/or externally to and/or from, for example, one or more of a DSP, microcontroller, microprocessor, ASIC, FPGA, CLD, ADC, DAC, etc. and/or combinations of these to including sending a digital signal or signals comprising, for example, a digital representation of the dimming from the Triac, Triac-based, forward or reverse dimmer, etc. For example, the control shown in FIGS. 1 through 17 can be implemented with a microcontroller(s), microprocessor(s), DSP(s), FPGAs, CLD(s), ASICs, ICs, ADC, DAC, etc., a combinations of these embedded or not into an IC, etc. including using a microcontroller to drive the square- or sine-wave stage of FIGS. 1 through 9 and half bridge (which could also be a push-pull, full bridge or any other suitable square- or sine-wave drive) in FIGS. 10 through 16. Such a drive could consist of one PWM out that is inverted and buffered to drive switches 148, 150, respectively or, as another example, a microcontroller(s), microprocessor(s), DSP(s), FPGAs, CLD(s), ASICs, ICs, DAC, ADC, etc., a combinations of these embedded or not into an IC, that has two PWM outputs which are complementary with one PWM driving the gate of switch 148 and the other 180 degree out of phase PWM driving the gate of switch 150. Of course, appropriate dead time between the gate drive PWM signals would be incorporated into any implementation. This digital PWM gate drive could be as complex as needed including having a dimming PWM built-in, changing frequency, period, on-time, off-time, etc. to provide digital dimming based on the Triac, Triac-based, other forward or reverse dimmer input signal to the universal dimmable driver. The above is meant to provide examples of the present invention; nothing in the above is meant to be or should be viewed as limiting regarding the present invention based on the above.

Implementations of the present invention allow for universal dimming using, for example, a phase detector that takes in a signal from a Triac or other phase angle/phase cut dimmer including forward and reverse dimmers such that the phase angle sets the output of the present invention. One exemplary way to accomplish this is to detect the phase angle of the dimmer using, for example, a duty cycle on-time based transfer function for the phase angle to determine the reference voltage to set the current (or voltage) control level of the dimmable universal driver or power supply. Other example embodiments can use one or more of a microcontroller, microprocessor, digital state machines, FPGA, DSP, CLD, DAC, ADC, etc. to determine the minimum and maximum phase angles, respectively and set the output(s) accordingly as discussed herein. As discussed, the relation between the reference level to the set and actual current (or voltage) can be linear, quadratic, power law, square, square root, logarithmic, exponential, sub-linear, super-linear, etc. In addition, the reference signal can be analog, digital or a combination of these. The phase detector can, for example, provide a digital representation and effectively digitize the phase angle information into on or off, true or false, high or low, one or zero, or, for example, a 0 or 5 V signal, a 0 or 10 V signal, etc. using a phase processor which in some example embodiments is a microcontroller that takes in and effectively analyzes the phase information from the dimmer detector and processes that information to a usable result.

Examples of such results could be a digital signal such as a pulse width modulated signal with, for example, a frequency in the range of a few to several hundred Hertz (or higher) that feeds to and modulates the output current (or voltage) from full set current (or voltage) to fully off with a PWM relationship related to the Triac or other phase dimmer phase information. The PWM output result can also be effectively turned into an averaged analog signal by inserting a capacitor in between the resulting output of the phase processor and the circuit/components that set and control the output current (or voltage). With the present invention, the driver or power supply can be designed and implemented to put out a set current (or voltage) output regardless of the input AC voltage that effectively allows a set output current over whatever specified input voltage including a universal voltage range such as, for examples, 100 to 240 VAC, 80 to 305 VAC and higher. The phase angle can be digitized into any number of bits including, for example, 8 bits (i.e., 256 levels), 10 bits (i.e., 512 levels), 12 bits (i.e., 1024 levels), and higher, etc. The digitization of the Triac or other phase angle dimmer signal/information can be accomplished by a number of methods including, but not limited to, using a detector that measures the on and off time of the Triac or other phase angle dimmer. In some embodiments, the detector comprises a Zener diode in series with one of more resistors that may also be in series or parallel with other resistors such as to produce a saturated or maximum signal (for example 10 V) that can be further scaled (including up and down in voltage range) and fed into, for example but not limited to, a microcontroller or microcontrollers, microprocessor(s), FPGA(s), DSP(s), digital state machines, application specific integrated circuit(s) (ICs), other ICs, digital to analog converters (DACs), analog to digital converters (ADCs), system on a chip (SOC), other analog and digital circuits, etc. that produces an output signal or signals that can be fed to the current (or voltage) control circuitry, electronics, and systems, etc. A combination of analog and digital or analog or digital circuits including those incorporated into ASICs, ICs, etc. may be used. As mentioned previously, the current (or voltage) can be controlled, commanded, set in either a digital fashion (e.g., PWM duty cycle on/off modulated) or analog (e.g., reduced or increased in amplitude/value/level as the dimmer dimming level is reduced or increased, respectively).

In various embodiments, 0-10 dimming can be readily and easily implemented with the present invention by providing a 0 to 10 V dimming signal (or a scaled version—e.g., 0 to 3 V using a simple voltage divider) or offset and truncated ranges such as 1 to 8 V, 2 to 6 V, 1 to 9 V, 1 to 10 V, or higher or lower or negative, etc. in place of or in conjunction with the phase processor signal that is applied to either or both the reference that sets the current (or voltage) level or the pulse width generator input. For example, this can be accomplished by providing a 0-10 V (or any range of) dimming signal to the phase processor for use in controlling the output of the phase processor or by providing the 0-10 V dimming signal to the reference current generator against which the load current measurement is compared or by providing the 0 to 10 V signal (or an appropriately scaled version) to the input of the PWM pulse width generator. Some embodiments may be dual dimming, supporting the use of a 0-10 V dimming signal in addition to a Triac-based or other phase-cut or phase angle dimmer. In addition, the resulting dimming, including current or voltage dimming, can be either PWM (digital) or analog dimming or both or selectable either manually, automatically, or by other methods and ways including software, remote control of any type including, but not limited to, wired, wireless, voice, voice recognition, gesturing including hand and/or arm gesturing, pattern and motion recognition, PLC, RS232, RS422, RS485, SPI, I2C, universal serial bus (USB), Firewire, etc. Voice, voice recognition, gesturing, motion, motion recognition, etc. can also be transmitted via wireless, wired and/or powerline communications.

Figure 18:
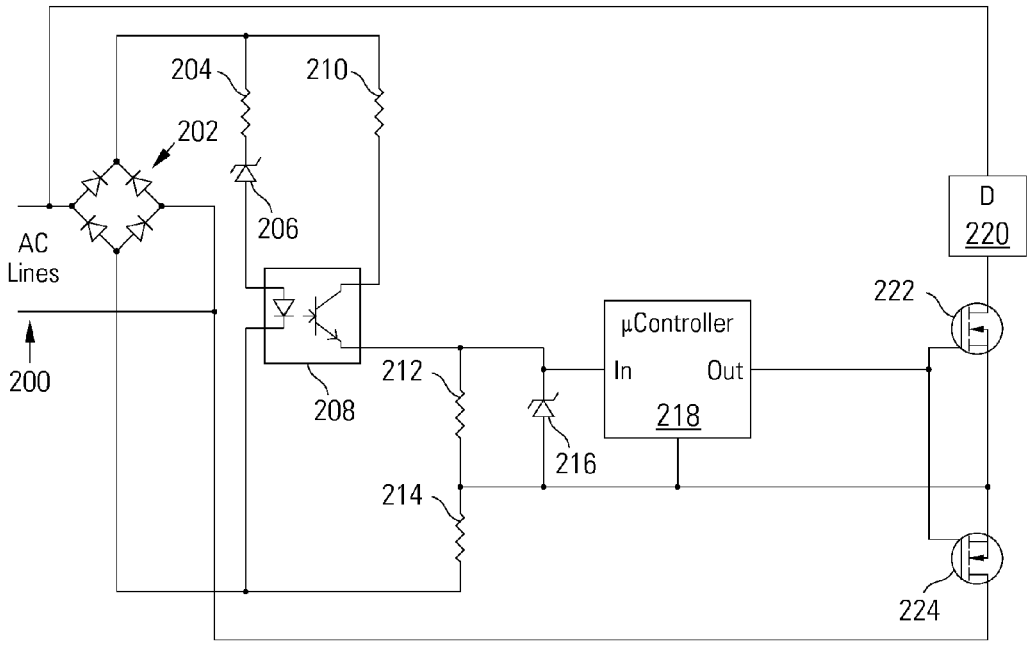
FIG. 18 depicts a block diagram of one example of a universal digital dimmer using a microcontroller and one or more transistors in accordance with some embodiments.
Figure 19:
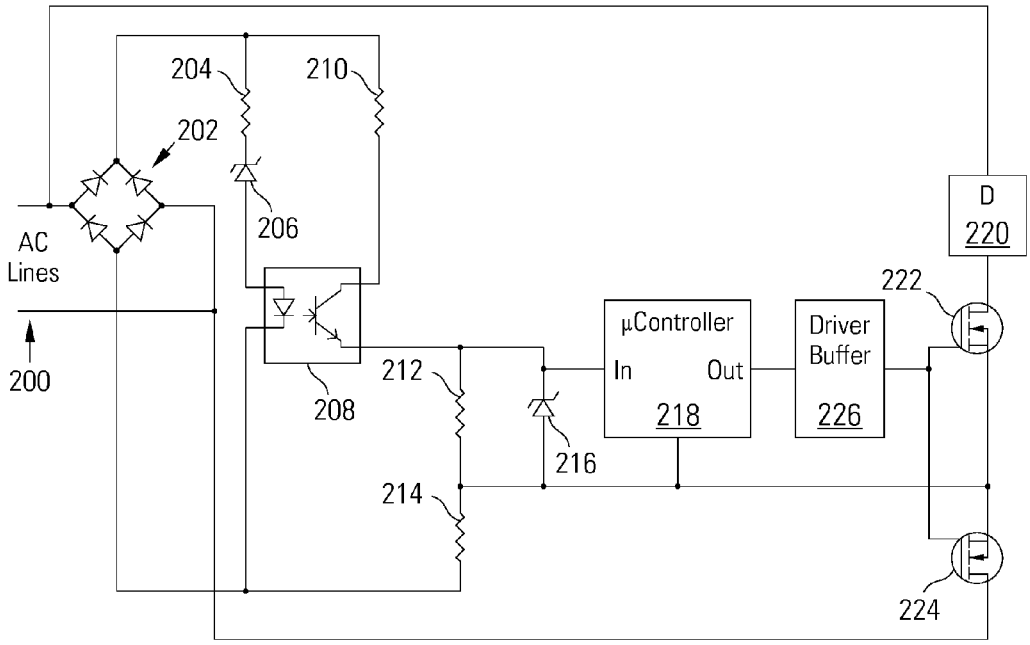
FIG. 19 depicts a block diagram of one example of a universal digital dimmer using a microcontroller with a buffer/driver and one or more transistors in accordance with some embodiments.

Referring to FIG. 18, the present invention also includes universal dimmers based on digital control 218 using, for example, a microcontroller(s), microprocessor(s), DSP(s), FPGAs, CLD(s), ASICs, ICs, digital to analog converters (DACs), analog to digital converters (ADCs), etc., a combinations of these embedded or not into an IC, etc. to drive, for example, source-to-source and gate-to-gate MOSFETs 222, 224 so as to be able to provide either (or both) a forward or reverse phase angle/phase cut dimmer that can be designed and implemented to operate over any voltage range including, but not limited to, 100 to 120 VAC, 100 to 240 VAC, 100 to 277 VAC, 100 to 305 VAC, 200 to 240 VAC, 347 VAC, 480 VAC, 100 to 480 VAC, etc. In FIG. 18, diode bridge 202, optional diode 206, resistor 204, opto-coupler 208 along with resistors 210, 212, 214 and Zener Diode 216 form a zero-detect/zero-crossing detector for the AC voltage to effectively synchronize and float the microcontroller(s), microprocessor(s), DSP(s), FPGAs, CLD(s), ASICs, ICs, digital to analog converters (DACs), analog to digital converters (ADCs), etc., a combinations of these embedded or not into an IC, etc. to drive the gates of transistors 222, 224 in FIG. 18. The zero-crossing detector is meant to be an illustrative example and not to be limiting in any way or form. For example, opto-coupler 208 could be replaced with an AC opto-coupler such that Bridge 202 and diode 206 are not needed nor required. In FIGS. 18 through 21, block 220 represents one or more digital dimmable drivers or other dimmable drivers, ballasts, power supplies that can be dimmed via a phase cut/phase angle signal. The present invention also allows for and supports direct (i.e., without the need for phase angle dimming) digital dimming from the digital dimmer to the digital dimmable driver. Power connections for the microcontroller 218, etc. have been omitted for clarity in FIGS. 18 through 21. FIG. 19 includes a driver buffer stage between the microcontroller(s), microprocessor(s), DSP(s), FPGAs, CLD(s), ASICs, ICs, digital to analog converters (DACs), analog to digital converters (ADCs), etc., a combinations of these embedded or not into an IC, etc. and the gates of transistors 222, 224. The driver buffer stage can consist of any analog and/or digital circuits, components, devices, digital logic such as NAND, NOR, inverter gates, etc. as needed depending on the particular implementation, embodiment, application, etc. Additional components, devices, etc. including additional resistors to measure, for example, the current through and the voltage across, the digital dimmer of FIGS. 18 and 19 may be incorporated into embodiments of the present invention to allow for, for example, monitoring and control of the input current, input voltage, input power, power factor, energy used, dimming, dimming level, status, along with additional components on the digital dimmable driver to measure output power, output lumens, output current, output voltage, etc.

The block boxes labeled Buck or Boost-Buck, etc. control in FIGS. 10 through 17 and Control in FIGS. 10 through 16 are intended to be illustrative and representative of the digital and analog circuits and systems that make up the universal dimming drivers and power supplies and could consist of an integrated/incorporated/embedded/etc. state machine, microcontroller, microprocessor, DSP, FPGA, CLD, digital to analog converters (DACs), analog to digital converters (ADCs), etc. that also performs, assists, controls, sets, and/or works in conjunction with the buck, boost, boost-buck, buck-boost, flyback, forward converter, feedback control, current or voltage control and sensing, etc. for the universal dimming driver including universal digital dimming driver/power supply. In other embodiments of the present invention the dimming processing and control can be separate and not integrated into the buck, boost, boost-buck, buck-boost, flyback, forward converter, feedback control, current or voltage control and sensing, etc. circuits and/or integrated circuits, etc. Although part of the Control is shown separate and potentially at a different voltages and local ground potentials (i.e., high side or low side or secondary of an isolated driver or power supply), in embodiments of the present invention, all of the control circuits, ICs, and embedded/integrated/incorporated phase sensing and dimming including digital dimming can be incorporated into either a single or multiple ICs all at the same ground potential or can be one or more ICs all at the same ground potential including for isolated and non-isolated drivers and power supplies including universal dimming and universal digital dimming drivers and power supplies. Embodiments and implementations of the present invention can employ any combination of embedded or non-embedded circuits to achieve universal dimming drivers/power supplies including universal digital dimming drivers/power supplies including single integrated circuit implementations that can provide input to output transformations/relations/functions including, but not limited to, for either or both input phase cut angle and input voltage to output current or voltage. Such embodiments can also include other wired and/or wireless ways, means, methods, etc. of dimming including digital dimming. Such embodiments may use user input for, for example, input AC phase angle cut to output current. In addition, built-in, user defined, programmable, and/or downloadable, etc. algorithms, firmware, software, hardware, transformations, mathematical equations and expressions, etc. can be used to define and implement, for example, the AC input phase angle to output current or voltage. Such built-in, user defined, programmable, and/or downloadable, etc. algorithms, equations, function, transformations, etc. can be stored and retrieved and adapted to universally work with any Triac and/or forward/reverse phase dimmer regardless of the phase angle range to achieve the desired driver/power supply output response including from minimum to maximum output (i.e., typically current or voltage), again, regardless of the range of AC input phase angle of the Triac and/or forward/reverse dimmer.

Figure 20:
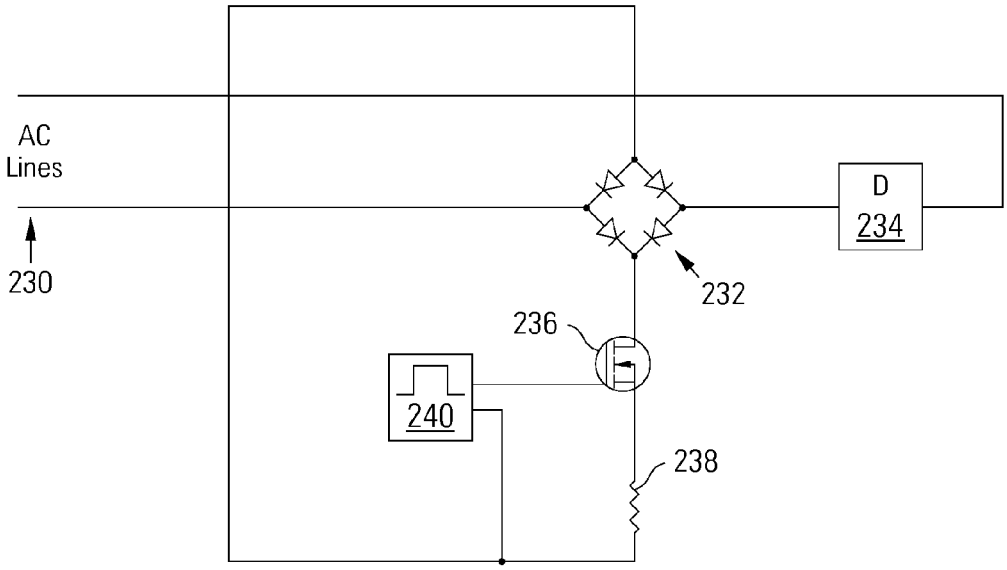
FIG. 20 depicts a block diagram of one example of a universal digital dimmer using a controller which may include a microcontroller with a buffer/driver and a diode bridge and one or more transistors in accordance with some embodiments.
Figure 21:
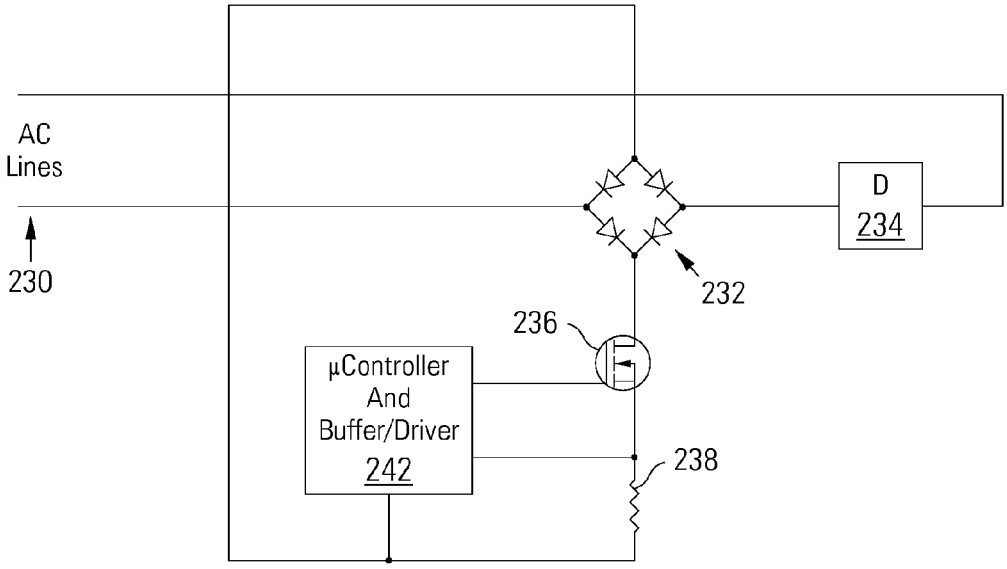
FIG. 21 depicts a block diagram of one example of a universal digital dimmer using a microcontroller with a buffer/driver and a diode bridge and one or more transistors in accordance with some embodiments.

Referring to FIGS. 20 and 21, the present invention also includes universal dimmers based on digital control using, for example, (FIG. 20) variable pulse generator, PWM, timer, etc. drive 240 and (FIG. 21) a driver 242 comprising a microcontroller(s), microprocessor(s), DSP(s), FPGAs, CLD(s), ASICs, ICs, digital to analog converters (DACs), analog to digital converters (ADCs), etc., and combinations of these embedded or not into an IC, etc. to drive, for example a MOSSFET 236 (or other type of transistor or switch including, but not limited to a BJT, JFET, SiCFET, GaNFET, etc.) so as to be able to provide either (or both) a forward or reverse phase angle/phase cut dimmer that can be designed and implemented to operate over any voltage range including, but not limited to, 100 to 120 VAC, 100 to 240 VAC, 100 to 277 VAC, 100 to 305 VAC, 200 to 240 VAC, 347 VAC, 480 VAC, 100 to 480 VAC, etc. A similar zero-detect circuit as in FIGS. 18 and 19 as well as zero-detect/zero-crossing circuits that do not require either an opto-coupler or a separate bridge can be used with the embodiments depicted in FIGS. 20 and 21. Again, the zero-crossing detector is meant to be an illustrative example and not to be limiting in any way or form. Resistor 238 in FIG. 21 can be used for a number of purposes including to measure and monitor the current through the digital dimmer and to provide protection detection in the case of overcurrents so as to either or both digitally and/or analog trip and protect the digital dimmer in the event of an overcurrent event(s). Such protection can involve, as an example, among a number of other things, etc., acting as a circuit breaker and appropriately shutting off the gate signal to transistor 236 in FIGS. 20 and 21 and transistors 222, 224 in FIGS. 18 and 19, respectively. The present invention also allows for and supports direct (i.e., without the need for phase angle dimming) digital dimming from the digital dimmer to the digital dimmable driver. FIG. 19 includes a driver buffer stage between the microcontroller(s), microprocessor(s), DSP(s), FPGAs, CLD(s), ASICs, ICs, digital to analog converters (DACs), analog to digital converters (ADCs), etc., a combinations of these embedded or not into an IC, etc. and the gates of transistors 222, 224. The driver buffer stage can consist of any analog and/or digital circuits, components, devices, digital logic such as NAND, NOR, inverter gates, etc. as needed depending on the particular implementation, embodiment, application, etc.

Figure 22:
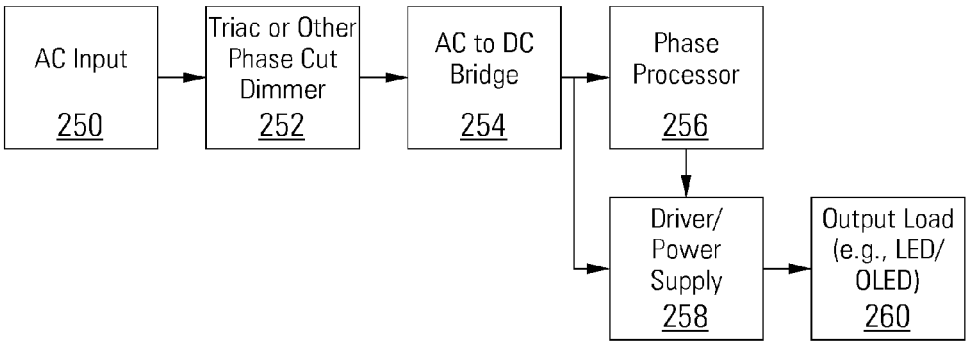
FIG. 22 depicts a block diagram of one example of a dimmable driver system with phase processing in accordance with some embodiments.
Figure 23:
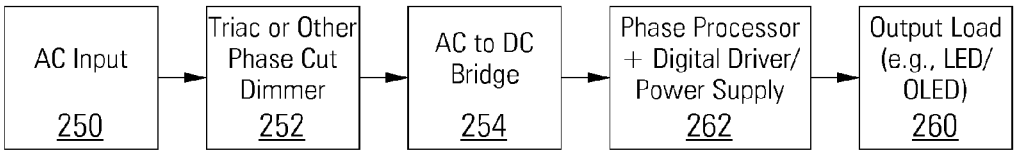
FIG. 23 depicts a block diagram of one example of a dimmable driver system with phase processing and a digital driver in accordance with some embodiments.

FIGS. 22 and 23 show block diagrams illustrating some exemplary example embodiments of the present invention. Referring to FIG. 22, a Triac or other phase cut dimmer 252 such as a forward/reverse dimmer, connected to an AC input 250, feeds power and phase information to the AC to DC bridge 254 which provides rectified waveforms to the phase processor (which can be, for example, but not limited to, embedded or separate microcontroller(s), microprocessor(s), DSP(s), FPGA(s), digital to analog converters (DACs), analog to digital converters (ADCs), etc., digital state machine(s), etc.) and also to the driver 258 which is controlled by the phase processor 256 to produce an output to a load 260 that is determined by the phase processor via algorithms, functions, firmware, etc. Such a block diagram can also include embodiments shown in the previous figures including FIGS. 10 through 17. Referring to FIG. 23, a Triac or other phase cut dimmer 252 such as a forward/reverse dimmer feeds power and phase information to the AC to DC bridge 254 which provides rectified waveforms to an integrated/embedded phase processor/driver/power supply 262 (which can include microcontroller(s), microprocessor(s), DSP(s), FPGA(s), digital to analog converters (DACs), analog to digital converters (ADCs), etc., digital state machine(s), etc.), to produce an output that is determined by the phase processor via algorithms, functions, firmware, etc. Such a block diagram can also include embodiments shown in the previous figures including FIGS. 10 through 17.

In addition, embodiments and implementations of the present including, but not limited to, those represented and depicted in FIGS. 1 through 23 can also include wireless and/or wired communications that permit both control and monitoring which also allows data logging and analytics to be performed with the present invention. As illustrated in FIGS. 18 to 21, wireless or wired dimming can also be accomplished using microprocessor(s), microcontroller(s), DSP(s), FPGA(s), digital to analog converters (DACs), analog to digital converters (ADCs), etc. that either have built-in wireless capability or interface to a wireless (ie., radio frequency (RF), infrared, microwave, millimeter-wave, etc.) receiver and/or transmitter. The present invention also allows direct communication between wired and/or wireless dimmers and drivers/power supplies for, among other things, uses, applications, etc., lighting including, but not limited to, LEDs and OLEDs.

The present invention can be applied to all sorts and types of general lighting including but not limited to cold cathode fluorescent lamps (CCFLs), fluorescent lamps (FLs), compact fluorescent lamps (CFLs), light emitting diodes (LEDs), organic LEDs (OLEDs), high intensity discharge (HID), etc. in addition to other driver, ballast and general usage power supply applications.

The present invention may provide thermal control or other types of control to, for example, a dimming LED driver. For example, the circuits shown in the figures or variations thereof may also be adapted to provide overvoltage or overcurrent protection, short circuit protection for, for example, a dimming LED driver, or to override and cut the phase and power to the dimming LED driver(s) based on any arbitrary external signal(s) and/or stimulus. The present invention can also include circuit breakers including solid state circuit breakers and other devices, circuits, systems, etc. that limit or trip in the event of an overload condition/situation. The present invention can also include, for example, analog or digital controls including but not limited to wired (i.e., 0 to 10 V, RS 232, RS485, IEEE standards, SPI, I2C, other serial and parallel standards and interfaces, etc.), wireless, powerline (PLC), etc. and can be implemented in any part of the circuit for the present invention. The present invention can be used with a buck, a buck-boost, a boost-buck and/or a boost, flyback, or forward-converter design etc., topology, implementation, etc.

Other embodiments can use comparators, other op amp configurations and circuits, including but not limited to error amplifiers, summing amplifiers, log amplifiers, integrating amplifiers, averaging amplifiers, differentiators and differentiating amplifiers, etc. and/or other digital and analog circuits, microcontrollers, microprocessors, complex logic devices, field programmable gate arrays, etc.

The present invention includes implementations that contain various other control circuits including, but not limited to, linear, square, square-root, power-law, sine, cosine, other trigonometric functions, logarithmic, exponential, cubic, cube root, hyperbolic, etc. in addition to error, difference, summing, integrating, differentiators, etc. type of op amps. In addition, logic, including digital and Boolean logic such as AND, NOT (inverter), OR, Exclusive OR gates, etc., complex logic devices (CLDs), field programmable gate arrays (FPGAs), microcontrollers, microprocessors, application specific integrated circuits (ASICs), digital to analog converters (DACs), analog to digital converters (ADCs), etc. can also be used either alone or in combinations including analog and digital combinations for the present invention. The present invention can be incorporated into an integrated circuit, be an integrated circuit, etc.

The present invention may use and be configured in continuous conduction mode (CCM), critical conduction mode (CRM), discontinuous conduction mode (DCM), resonant conduction modes, etc., with any type of circuit topology including but not limited to buck, boost, buck-boost, boost-buck, Ćuk, SEPIC, flyback, forward-converters, etc. For the respective configurations, examples of which are mentioned above, constant on time, constant off time, constant frequency/period, variable frequency, variable on time, variable off time, etc., as examples, can be used with the present invention. The present invention works with both isolated and non-isolated designs including, but not limited to, buck, boost-buck, buck-boost, boost, flyback and forward-converters. The present invention itself may also be non-isolated or isolated, for example using a tag-along inductor or transformer winding or other isolating techniques, including, but not limited to, transformers including signal, gate, isolation, etc. transformers, optoisolators, optocouplers, etc.

The present invention includes other implementations that contain various other control circuits including, but not limited to, linear, square, square-root, power-law, sine, cosine, other trigonometric functions, logarithmic, exponential, cubic, cube root, hyperbolic, etc. in addition to error, difference, summing, integrating, differentiators, etc. type of op amps. In addition, logic, including digital and Boolean logic such as AND, NOT (inverter), OR, Exclusive OR gates, etc., complex logic devices (CLDs), field programmable gate arrays (FPGAs), microcontrollers, microprocessors, application specific integrated circuits (ASICs), digital to analog converters (DACs), analog to digital converters (ADCs), etc. can also be used either alone or in combinations including analog and digital combinations for the present invention. The present invention can be incorporated into an integrated circuit, be an integrated circuit, etc.

The present invention can also incorporate at an appropriate location or locations one or more thermistors (i.e., either of a negative temperature coefficient [NTC] or a positive temperature coefficient [PTC]) to provide temperature-based load current limiting.

When the temperature rises at the selected monitoring point(s), the phase dimming of the present invention can be designed and implemented to drop, for example, by a factor of, for example, two. The output power, no matter where the circuit was originally in the dimming cycle, will also drop/decrease by some factor. Values other than a factor of two (i.e., 50%) can also be used and are easily implemented in the present invention by, for example, changing components of the example circuits described here for the present invention. As an example, a resistor change would allow and result in a different phase/power decrease than a factor of two. The present invention can be made to have a rather instant more digital-like decrease in output power or a more gradual analog-like decrease, including, for example, a linear decrease in output phase or power once, for example, the temperature or other stimulus/signal(s) trigger/activate this thermal or other signal control.

In other embodiments, other temperature sensors may be used or connected to the circuit in other locations. The present invention also supports external dimming by, for example, an external analog and/or digital signal input. One or more of the embodiments discussed above may be used in practice either combined or separately including having and supporting both 0 to 10 V and digital dimming. The present invention can also have very high power factor. The present invention can also be used to support dimming of a number of circuits, drivers, etc. including in parallel configurations. For example, more than one driver can be put together, grouped together with the present invention.

The transistors, switches and other devices, etc. may include any suitable type of transistor or other device, such as a bipolar transistor, including bipolar junction transistors (BJTs) and insulated gate bipolar transistors (IGBTs, or a field effect transistor (FET) including n and/or p channel FETs such as junction FETs (JFETs), metal oxide semiconductor FETs (MOSFETs), metal insulator FETs (MISFETs), metal emitter semiconductor FETs (MESFETs) of any type and material including but not limited to silicon, gallium arsenide, indium phosphide, gallium nitride, silicon carbide, silicon germanium, diamond, graphene, and other binary, ternary and higher order compounds of these and other materials. In addition, complementary metal oxide semiconductor n and p channel MOSFET (CMOS), heterojunction FET (HFET) and heterojunction bipolar transistors (HBT), bipolar and CMOS (BiCMOS), BCD, modulation doped FETs, (MODFETs), etc, and can be made of any suitable material including ones made of silicon, gallium arsenide, gallium nitride, silicon carbide, etc. which, for example, has a suitably high voltage rating. The variable pulse generator may use any suitable control scheme, such as duty cycle control, frequency control, pulse width control, pulse width modulation, etc. Any type of topology including, but not limited to, constant on time, constant off time, constant, frequency, variable frequency, variable duration, discontinuous, continuous, critical conduction modes of operation, CUK, SEPIC, boost-buck, buck-boost, buck, boost, etc. may be used with the present invention. The use of the term variable pulse generator is not intended to be limiting in any way or form but merely to attempt to describe part of the function performed by the present invention, namely to provide a signal that switches power (i.e., current and voltage) to a load such as the LED discussed in the present invention. The variable pulse generator can be made, designed, built, manufactured, implemented, etc. in various ways including those involving digital logic, digital, circuits, state machines, microelectronics, microcontrollers, microprocessors, digital signal processors, field programmable gate arrays (FPGAs), complex logic devices (CLDs), microcontrollers, microprocessors, digital to analog converters (DACs), analog to digital converters (ADCs), analog circuits, discrete components, band gap generators, timer circuits and chips, ramp generators, half bridges, full bridges, level shifters, difference amplifiers, error amplifiers, logic circuits, comparators, operational amplifiers, flip-flops, counters, AND, NOR, NAND, OR, exclusive OR gates, etc. or various combinations of these and other types of circuits.

The dimming to universal invention presented here can be accomplished with a number of approaches including but not limited to those listed below associated with, for example, an input voltage variable signal that reaches a maximum level at a certain set or value of, for example, input voltage level or conditions (e.g. input voltage reaches, for example, 120 VAC, 240 VAC and/or 277 VAC root mean square (RMS):

- Control on high (output) side with two or more time constants
- Control on high (output) side with fast feedback to bypass time constant when set current is exceeded
- Control on high (output) side with two or more time constants with fast feedback to bypass time constant when set current is exceeded
- Control, PWM, dimming phase processor all at the same potential and using a common ground or local ground.
- Control, PWM, dimming phase processor all integrated into a single IC.
- No high side electronic or ICs (for non-isolated) or secondary side (for isolated) electronics or ICs necessary for certain embodiments of the present invention.
- Universal input AC phase and voltage.
- Algorithms can be preprogrammed, user-defined, downloadable, modified, adapted, enhanced, stored and retrieved.
- Virtually no limit to the number of algorithms, functions, look up tables, equations, etc. that can be stored and retrieved.
- Can support wireless or wired dimmers and driver systems in addition to phase angle dimming.
- Can respond and act on voice and voice commands.
- Can respond and act on gesturing.
- No capacitor on the output side
- No time constant on the output side
- Voltage controlled output with current limit
- DC (low ripple) circuit on high side
- Dimming control on high side
- Wireless control and monitoring
- Wireless PWM controller
- AND gates and/or transistor switches, etc. to limit/turn-off PWM
- More complicated Boolean algebra and state/timing approaches to control and limit current
- Control on high (output) side with slow feedback (can be more than one time constant)
- Control on high side with fast response but slow time constant on low side
- Digital control on high (output) side
- Wall Dimming to digital/analog dimming
- Wall Dimming to wireless dimming
- AC input transformer
- Combination of wall dimming and other types of analog and digital dimming, with communication and control including but not limited to wired and wireless interfaces, such as a digital addressable lighting interface (DALI), DMX, 0 to 10 V DC (and other voltage ranges) analog, pulse width modulation (PWM), digital multiplexing (DMX), powerline dimming, etc.

Dimming control can be performed using a controller implementing motion detection, recognizing motion or proximity to a detector or sensor and setting a dimming level in response to the detected motion or proximity, or with audio detection, for example detecting sounds or verbal commands to set the dimming level in response to detected sounds, volumes, or by interpreting the sounds, including voice recognition or, for example, by gesturing including hand or arm gesturing, etc.

The above is merely meant to provide illustrative examples and should not be construed or taken as limiting in any or form for the present invention.

What is claimed is:

1. A digital dimmable driver system, comprising:

an alternating current input;

a dimmer operable to perform a phase cut operation on a waveform from the alternating current input;

a driver circuit operable to switch from a dimming mode to a universal voltage input mode based on a phase angle of the dimmer, wherein the digital dimmable driver system comprises at least one algorithm to determine a minimum output and a maximum output based on a minimum phase angle and a maximum phase angle, wherein the driver circuit is configured to output an output current level as a function of an input voltage level up to a maximum output current level and to output the maximum output current level independent of the input voltage level as the input voltage level increases after the output current level has reached the maximum output current level; and a power output operable to power a light.

2. The system of claim 1, further comprising a dimming detector configured to detect a phase angle of the dimmer.

3. The system of claim 1, further comprising a rectifier configured to rectify the waveform from the alternating current input.

4. The system of claim 1, further comprising a power converter configured to regulate power from the alternating current input.

5. The system of claim 4, wherein the power converter comprises a buck converter.

6. The system of claim 4, wherein the power converter comprises a boost-buck converter.

7. The system of claim 4, wherein the power converter comprises a variable pulse generator configured to control regulation in the power converter.

8. The system of claim 7, wherein the variable pulse generator is configured to operate with a plurality of different input voltage ranges.

9. The system of claim 8, wherein the variable pulse generator is configured to dynamically select an appropriate dimming range.

10. The system of claim 8, wherein the variable pulse generator is configured to limiting a maximum output current regardless of input voltage.

11. The system of claim 7, further comprising a load current detector configured to detect a current level through the power output.

12. The system of claim 11, wherein the variable pulse generator is configured to control an output pulse width based at least in part on the current level through the power output.

13. The system of claim 12, wherein the variable pulse generator is configured to restrict the output pulse width only when the current level through the power output has reached a maximum allowable level.

14. The system of claim 11, wherein the load current detector comprises at least one time constant configured to allow detection of voltage changes in the alternating current input and to filter out faster changes at the power output.

15. The system of claim 10, further comprising a current overload protection circuit configured to restrict pulses from the variable pulse generator when a current through the power output exceeds a threshold.

16. The system of claim 10, further comprising a thermal protection circuit configured to restrict pulses from the variable pulse generator when a temperature in the system exceeds a threshold.

17. The system of claim 1, wherein the driver circuit comprises a microcontroller configured to control a current through the power output based on the phase angle of the dimmer.

18. The system of claim 1, wherein the driver circuit comprises a microcontroller configured to control a current through the power output based on a duty cycle of the dimmer.

19. The system of claim 1, wherein the driver circuit is configured to sense which of a plurality of input voltage ranges is applied at the alternating current input and to switch a dimming range based on the sensed input voltage range.

* * * * *